US009746225B2

(12) United States Patent
Eom et al.

(10) Patent No.: US 9,746,225 B2
(45) Date of Patent: Aug. 29, 2017

(54) REFRIGERATOR, HOME APPLIANCE, AND METHOD OF OPERATING THE SAME

(71) Applicant: LG Electronics Inc., Seoul (KR)

(72) Inventors: Yonghwan Eom, Seoul (KR); Kibae Lee, Seoul (KR); Sangbok Choi, Seoul (KR); Namki Lee, Seoul (KR); Chungill Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 668 days.

(21) Appl. No.: 14/146,483

(22) Filed: Jan. 2, 2014

(65) Prior Publication Data

US 2014/0182318 A1 Jul. 3, 2014

(30) Foreign Application Priority Data

Jan. 2, 2013 (KR) ..... 10-2013-0000341
Jan. 8, 2013 (KR) ..... 10-2013-0002175

(51) Int. Cl.

| | |
|---|---|
| ***F25B 49/00*** | (2006.01) |
| ***G05D 23/32*** | (2006.01) |
| ***F25B 49/02*** | (2006.01) |
| ***F25B 5/02*** | (2006.01) |

(52) U.S. Cl.
CPC ..... *F25B 49/02* (2013.01); *F25B 5/02* (2013.01); *F25B 2700/151* (2013.01)

(58) Field of Classification Search
CPC ..... F25B 49/02; F25B 2700/151; F25B 5/02
USPC ..... 62/180, 178, 126, 228.3, 157, 183, 340, 62/259.2
See application file for complete search history.

(56) References Cited

U.S. PATENT DOCUMENTS

| | | | | |
|---|---|---|---|---|
| 4,843,833 | A * | 7/1989 | Polkinghorne | F25D 17/065 62/126 |
| 5,970,729 | A * | 10/1999 | Yamamoto | F25D 16/00 165/80.4 |
| 2001/0054291 | A1* | 12/2001 | Roh | G10L 15/26 62/126 |
| 2002/0084655 | A1* | 7/2002 | Lof | F03D 7/0284 290/44 |
| 2003/0000236 | A1* | 1/2003 | Anderson | B60H 1/00421 62/228.3 |

(Continued)

FOREIGN PATENT DOCUMENTS

| | | | |
|---|---|---|---|
| CN | 1245283 | A | 2/2000 |
| CN | 101932836 | A | 12/2010 |
| WO | 2008120928 | A1 | 10/2008 |

*Primary Examiner* — Henry Chenshaw
(74) *Attorney, Agent, or Firm* — Dentons US LLP

(57) ABSTRACT

A refrigerator includes a motor to drive a compressor, an output current detector to detect an output current flowing to the motor, a compressor controller to calculate a power consumed in the compressor based on the detected output current, a plurality of power consuming units, and a main controller to receive the calculated compressor power consumption information, and when the plurality of power consuming units operate, to calculate a final power consumption using power consumption information stored for each power consuming unit and the calculated compressor power consumption information. Accordingly, computation of a power consumption may be simply performed.

10 Claims, 20 Drawing Sheets

(56) References Cited

U.S. PATENT DOCUMENTS

| | | | | |
|---|---|---|---|---|
| 2003/0095421 | A1* | 5/2003 | Kadatskyy | H02M 1/34 363/65 |
| 2003/0221435 | A1* | 12/2003 | Howard | F25B 9/008 62/228.3 |
| 2004/0112070 | A1* | 6/2004 | Schanin | F25D 29/00 62/132 |
| 2004/0255601 | A1* | 12/2004 | Kwon | F24F 11/0086 62/157 |
| 2005/0178135 | A1 | 8/2005 | Schanin et al. | |
| 2006/0112703 | A1* | 6/2006 | Singh | F25B 49/027 62/183 |
| 2006/0137382 | A1* | 6/2006 | Sasaki | F25C 1/04 62/340 |
| 2007/0089446 | A1* | 4/2007 | Larson | G05D 23/1931 62/259.2 |

* cited by examiner

FIG. 8

1010

| Power consuming unit | | Power consumption |
|---|---|---|
| Defrosting heater | | A1 |
| Home bar heater | | A2 |
| Circuit | | A3 |
| Mechanical fan motor | High | A4 |
| | Middle | A5 |
| | Low | A6 |
| Freezing compartment fan motor | High | A7 |
| | Middle | A8 |
| | Low | A9 |
| Others | | ... |

FIG. 15

500

| Operating conditions | | | PF | Power |
|---|---|---|---|---|
| F defrosting heater | R defrosting heater | Compressor | | |
| ON | ON | OFF | $K_1$ | $P_1$ |
| ON | OFF | OFF | $K_2$ | $P_2$ |
| ON | OFF | ON | $f_1(i)$ | $f_a(i)$ |
| OFF | OFF | ON | $f_2(i)$ | $f_b(i)$ |

REFRIGERATOR, HOME APPLIANCE, AND METHOD OF OPERATING THE SAME

CROSS-REFERENCE TO RELATED APPLICATION

This application claims the priority benefit of Korean Patent Application Nos. 10-2013-0000341, filed on Jan. 2, 2013 and 10-2013-0002175, filed on Jan. 8, 2013, in the Korean Intellectual Property Office, the disclosure of which are incorporated herein by reference.

BACKGROUND

Technical Field

The present disclosure relates to a refrigerator, a home appliance and a method of operating the same, and more specifically, to a refrigerator that may simply calculate power consumed, a home appliance, and a method of operating the same.

Background

In general, refrigerators are used to keep food fresh for a long time. A refrigerator has a freezing compartment for keeping food frozen, a refrigerating compartment for keeping food cold, and a cooling cycle for cooling the freezing compartment and refrigerating compartment. The operation of the refrigerator is controlled by a controller performing the cooling cycle.

As the kitchen area turns into a main family room from a mere "meal" space, the fridge, as a key element of the kitchen, demands to get bigger so that all of the family members can use it, and calls for an advance in functions in light of quality and quantity.

SUMMARY

One object is to provide a refrigerator that may simply conduct a computation of power consumed, a home appliance, and a method of operating the same.

To achieve the above-described objects, a refrigerator according to an embodiment of the present invention comprises a motor to drive a compressor, an output current detector to detect an output current flowing to the motor, a compressor controller to calculate a power consumed in the compressor based on the detected output current, a plurality of power consuming units, and a main controller to receive the calculated compressor power consumption information, and when plurality of power consuming units operate, to calculate a final power consumption using power consumption information stored for each power consuming unit and the calculated compressor power consumption information.

To achieve the above-described objects, a home appliance according to an embodiment of the present invention comprises a first power consumption unit, a first controller to calculate a first power consumed in the first power consuming unit, a plurality of power consuming units, and a main controller to receive the calculated first power information, and when the plurality of power consuming units operates, to calculate a final power consumption using power consumption information stored for each power consuming unit and the calculated power consumption information.

To achieve the above-described objects, a refrigerator according to an embodiment of the present invention comprises a plurality of power consuming units that consumes power, a current detector to detect a current of input power supplied to the refrigerator, and a controller to estimate a power factor based on the detected current and operating states of the plurality of power consuming units and to calculate a power consumed in the refrigerator based on the estimated power factor.

According to an embodiment of the present invention, a current flowing through a motor to drive a compressor is detected, a power consumed in the compressor is calculated based on the detected output current, and when plurality of power consuming units operates, a final power consumption is calculated using the pre-stored power consumption information for each unit and the calculated power consumption information. Accordingly, the overall power consumed in the refrigerator may be simply calculated.

In particular, the power consumed in the compressor is calculated by the compressor controller and is received by the main controller. Accordingly, the main controller may obtain the compressor power consumption calculated in the compressor controller without the need for separate computation.

Meanwhile, per-power consuming unit power consumption information pre-stored in the memory is used. Accordingly, the main controller may simply calculate the final power consumption by summing the compressor power consumption and the per-unit power consumption information.

According to another embodiment of the present invention, a power factor is estimated based on a current detected in the current detector to detect a current of input power supplied to the refrigerator and operating states of the compressor, freezing compartment defrosting heater, and refrigerating compartment defrosting heater, and based on the estimated power factor, a power consumed in the refrigerator may be calculated. Thus, computation of a power consumption may be simply conducted.

In particular, the measurement of power consumed in the compressor, the freezing compartment defrosting heater, and the refrigerating compartment defrosting heater is not performed. Instead, a power factor is estimated based on an input current and input voltage input to the refrigerator, and according to the estimated power factor, the refrigerator's power consumption is calculated. Accordingly, computation of a power consumption can be done easily.

According to still another embodiment of the present invention, power factor estimation and power consumption computation are carried out based on an input current entering the refrigerator and operating states of a plurality of power consuming units in the refrigerator. Accordingly, power consumption computation is straightforward.

BRIEF DESCRIPTION OF DRAWINGS

FIG. 8 is a view illustrating an example of power consumption for each unit, stored in a memory according to an embodiment of the present invention;

FIGS. 15 to 17*d* are views illustrating a method of calculating a power consumption in a refrigerator according to another embodiment of the present invention, based on FIG. 14.

DETAILED DESCRIPTION OF EMBODIMENTS

Hereinafter, the embodiments of the present invention is described in greater detail with reference to the accompanying drawings.

As used herein, the terms "module" and "unit" are provided for ease of description of the present disclosure, and the terms themselves do not convey especially important meanings or responsibilities. Accordingly, the terms "module" and "unit" may be mixed up.

Figure 1:
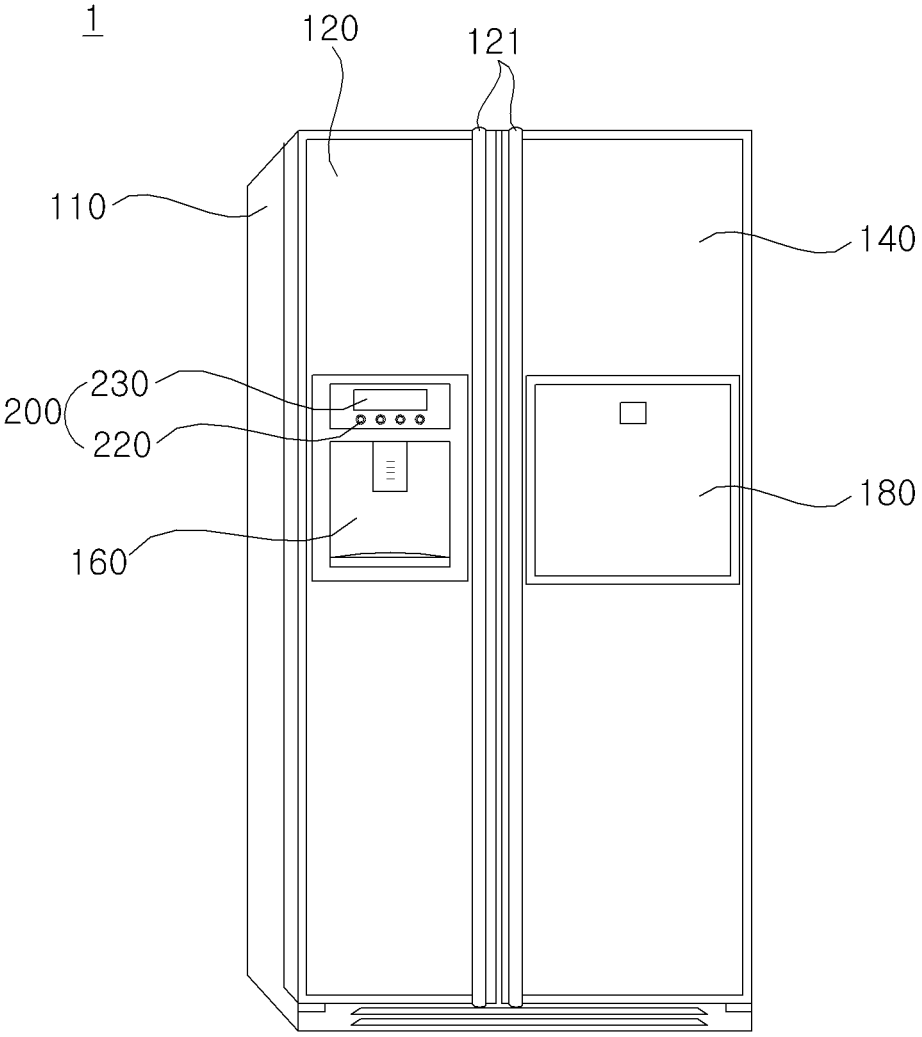
FIG. 1 is a perspective view illustrating a refrigerator according to an embodiment of the present invention.
Figure 3:
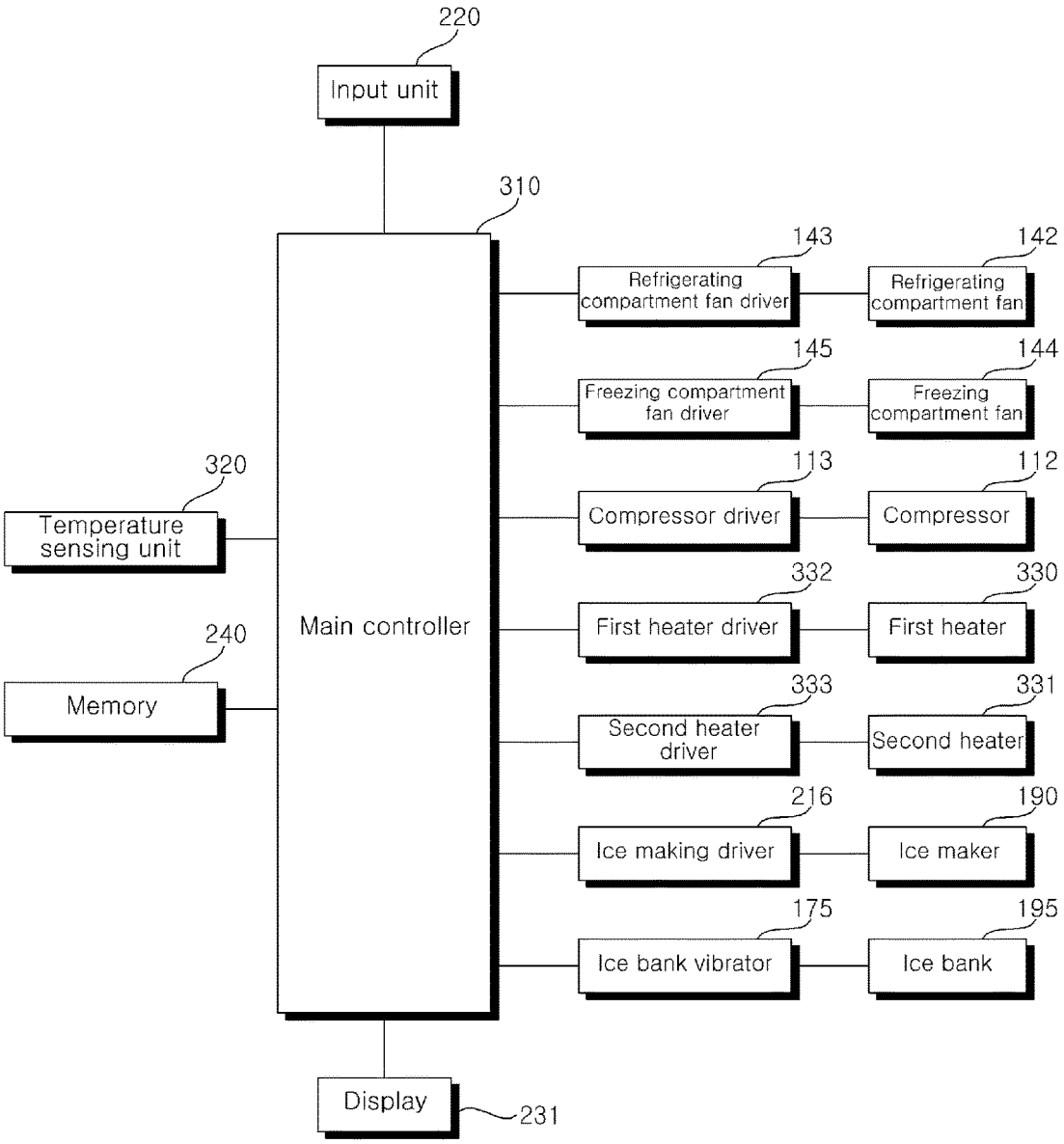
FIG. 3 is a block diagram schematically illustrating an example of a circuit unit in a refrigerator as shown in FIG. 1.

FIG. 3 is a block diagram schematically illustrating an example of a circuit unit in a refrigerator as shown in FIG. 1.

Referring to FIG. 3, the refrigerator includes a compressor 112, a refrigerating compartment fan 142, a freezing compartment fan 144, a main controller 310, a first heater 330, a second heater 331, a temperature sensing unit 320, and a memory 240. Further, the refrigerator may include a compressor driver 113, a refrigerating compartment fan driver 143, a freezing compartment fan driver 145, a first heater driver 332, a second heater driver 333, an ice making driver 216, an ice bank vibrator 175, a display 231, and an input unit 220.

Figure 2:
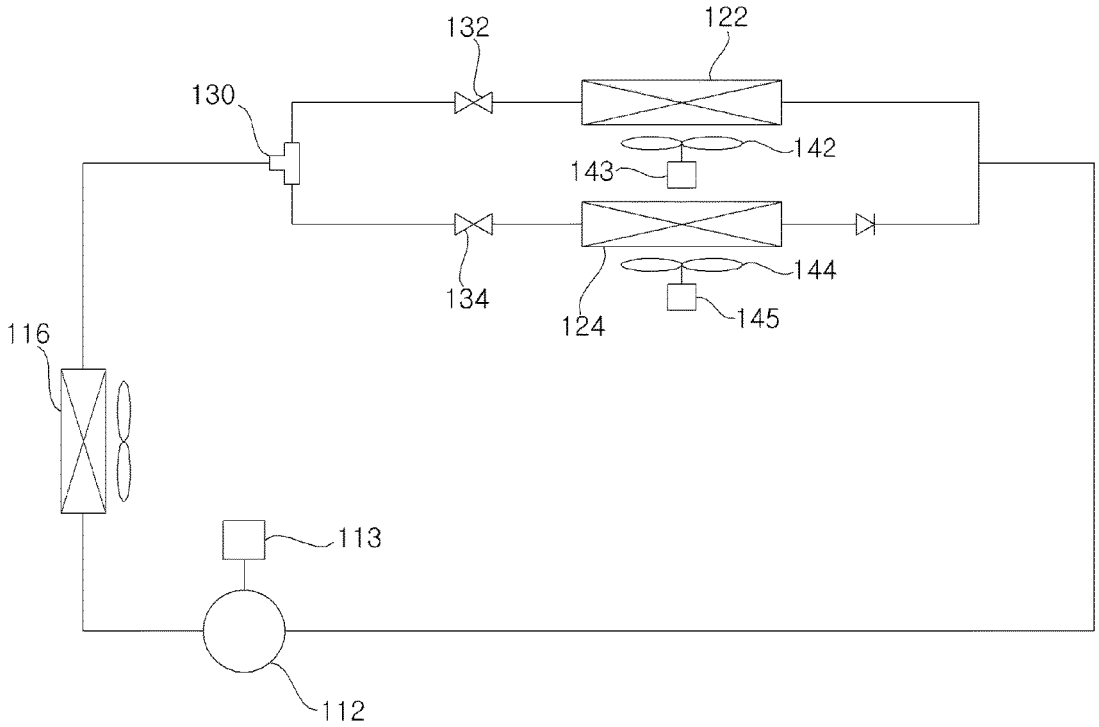
FIG. 2 is a diagram schematically illustrating an example of a circuit unit in a refrigerator as shown in FIG. 1.

FIG. 2 is a diagram schematically illustrating an example of a circuit unit in a refrigerator as shown in FIG. 1. Refer to FIG. 2 for the detailed description of the compressor 112, the refrigerating compartment fan 142, and the freezing compartment fan 144.

The input unit 220 includes multiple manipulation buttons and deliver a signal for a freezing compartment set temperature or refrigerating compartment set temperature as input to the main controller 310.

The temperature sensing unit 320 senses a temperature in the refrigerator and delivers a signal for the sensed temperature to the main controller 310. Here, the temperature sensing unit 320 senses each of a temperature of the refrigerating compartment and a temperature of the freezing compartment. Further, the temperature sensing unit 320 may sense a temperature of each chamber in the refrigerating compartment or each chamber in the freezing compartment.

The main controller 310, as shown in FIG. 3, directly controls the compressor driver 113 or refrigerating compartment fan driver 143 (or freezing compartment fan driver 145) to finally be able to control the compressor 112 and fan 142 or 144 in order to control the on/off operation of the compressor 112 and fan 142 or 144. Here, the fan driver may be the refrigerating compartment fan driver 143 or the freezing compartment fan driver 145.

For example, the main controller 310 includes a controller that may output speed command signals to a corresponding one of the compressor driver 113, the refrigerating compartment fan driver 143 and freezing compartment fan driver 145.

The above-described compressor driver 113 and the freezing compartment fan driver 145 includes a motor for compressor (not shown) and a motor for freezing compartment fan (not shown), and each of the motors (not shown) may operate at a targeted rotation speed under the control of the main controller 310.

Meanwhile, the refrigerating compartment fan driver 143 includes a motor for mechanic chamber fan (not shown) that may operate at a targeted rotational speed under the control of the main controller 310.

In case such motors are three-phase motors, the motors may be controlled by a switching operation in an inverter (not shown) or may be controlled at a static speed using AC power as is. Here, each motor (not shown) may be one of an induction motor, a BLDC (Brush-less DC) motor, or a synRM (synchronous reluctance motor).

The display 231 may display an operation state of the refrigerator. Meanwhile, according to an embodiment of the present invention, the display 231 may display a power consumption that is calculated by the main controller 310.

The memory 240 may store data necessary for operating the refrigerator. Meanwhile, according to an embodiment of the present invention, the memory 240 may store a detected current value, and a power factor or power factor computation equation corresponding to an operation state of a plurality of power consuming units, such as, e.g., the compressor.

Meanwhile, the main controller 310, as described above, may control the overall operation of the refrigerator 1 in addition to controlling the operation of the compressor 112 and fan 142 or 144.

For example, the main controller 310 may control the operation of the ice bank vibrator 175. In particular, upon sensing a full ice state, the main controller 310 performs control so that ice is withdrawn from an ice maker 190 to an ice bank 195. Further, the main controller 310 may control the ice bank 195 to vibrate when ice is withdrawn or in a predetermined time after ice withdrawal. As such, upon ice withdrawal, the ice bank 195 may be vibrated, so that ice may be evenly distributed in the ice bank 195 without tangling.

Further, the main controller 310 may vibrate the ice bank 195 repeatedly at a predetermined time interval in order to prevent the ice in the ice bank 195 from tangling.

Still further, the main controller 310, in case a dispenser 160 is operated by a user's manipulation, performs control so that ice in the ice bank 195 is withdrawn to the dispenser 160, and so that, upon ice withdrawal or immediately before ice withdrawal, the ice bank 195 is vibrated. Specifically, the main controller 310 may control the ice bank vibrator 175 so that the ice bank 195 operates. By doing so, the ice can be prevented from tangling up when ice is pulled out for a user.

The main controller 310 may control a heater (not shown) in the ice maker 190 to operate in order to remove ice from an ice making tray (not shown).

Meanwhile, the main controller 310, after the heater (not shown) turns on, may control the ice making driver 216 so that an ejector (not shown) in the ice maker 190 operates. This is a control operation for smoothly withdrawing ice to the ice bank 195.

Meanwhile, the main controller 310, when determining that the ice bank 195 is full of ice, may control the heater (not shown) to turn off. Further, the main controller 310 may control the ejector in the ice maker 190 to stop its operation.

Meanwhile, the main controller 310 may control the overall operation of the cooling cycle in compliance with a set temperature from the input unit 220. For example, the main controller 310 may further control a freezing compartment expansion valve 134 in addition to the compressor driver 113, the freezing compartment fan driver 145, and the refrigerating compartment fan driver 143. Further, the main controller 310 may control the operation of a condenser 116. Further, the main controller 310 may control the operation of the display 231.

Figure 4:
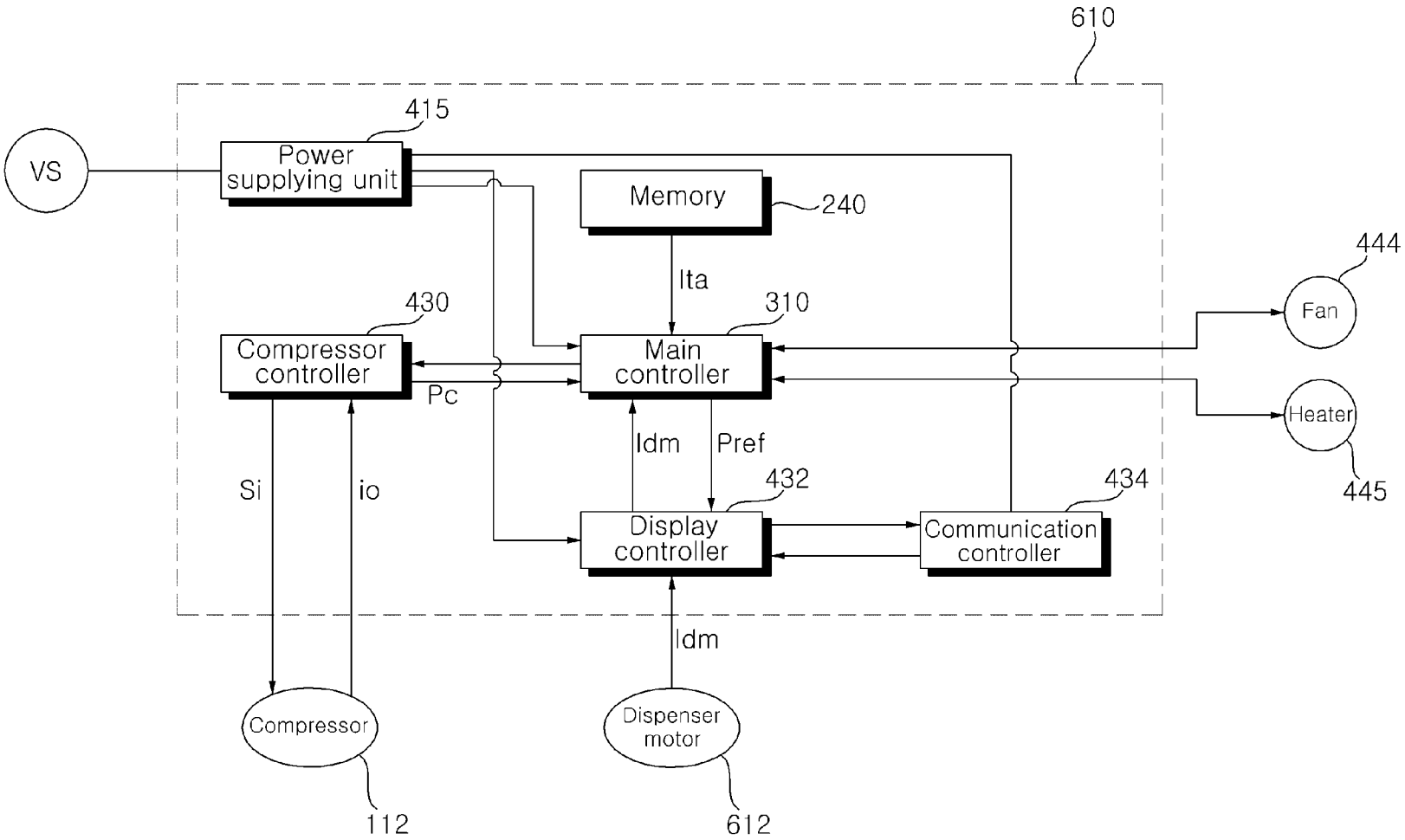
FIG. 4 is a view illustrating an example of a circuit unit in a refrigerator as shown in FIG. 1.

Meanwhile, referring to FIG. 4, according to an embodiment of the present invention, the main controller 310 may receive compressor power consumption information from a compressor controller 430, and based on whether a plurality of power consuming units operate, may store calculated final power consumption using the power consumption information pre-stored in each unit and calculated compressor power consumption information. This will be described later using FIG. 4 and subsequent drawings.

Meanwhile, the main controller 310 may perform a power compensation on the power consumption for some units that are in operation among the plurality of power consuming units and may obtain a final power consumption based on the compensated power consumption information and calculated compressor power consumption information. In particular, the main controller 310, in case some units are operated by AC power, may perform power compensation based on an instantaneous AC value.

Meanwhile, the main controller 310, in case some units in the refrigerator are operated by AC power, may compensate for the power consumption of some units using a difference between a DC value at a dc terminal that is an input terminal of an inverter (420 in FIG. 6) for driving a compressor 112 and a reference DC value and may calculate the final power that is consumed in the refrigerator based on the compensated power consumption information and calculated compressor power consumption information.

Meanwhile, the main controller 310 may compensate for the power that is consumed at each unit based on whether a plurality of power consuming units operate and a distribution in parts of the plurality of power consuming units as stored in the memory 240 and may acquire a final power consumption using the compensated power consumption information and compressor power consumption.

Meanwhile, in case the DC value at the dc terminal that is an input terminal of the inverter (420 in FIG. 6) for driving the compressor 112 is in excess of an allowable value for a predetermined time, the main controller 310 may perform power compensation on the power consumption for some units that are in operation among a plurality of power consuming units and may calculate a final power consumption based on the compensated power consumption information and the calculated compressor power consumption information. A detailed description of the above-described computation of final power consumption information by the main controller 310 will be given below with reference to FIG. 4 and subsequent drawings.

Figure 14:
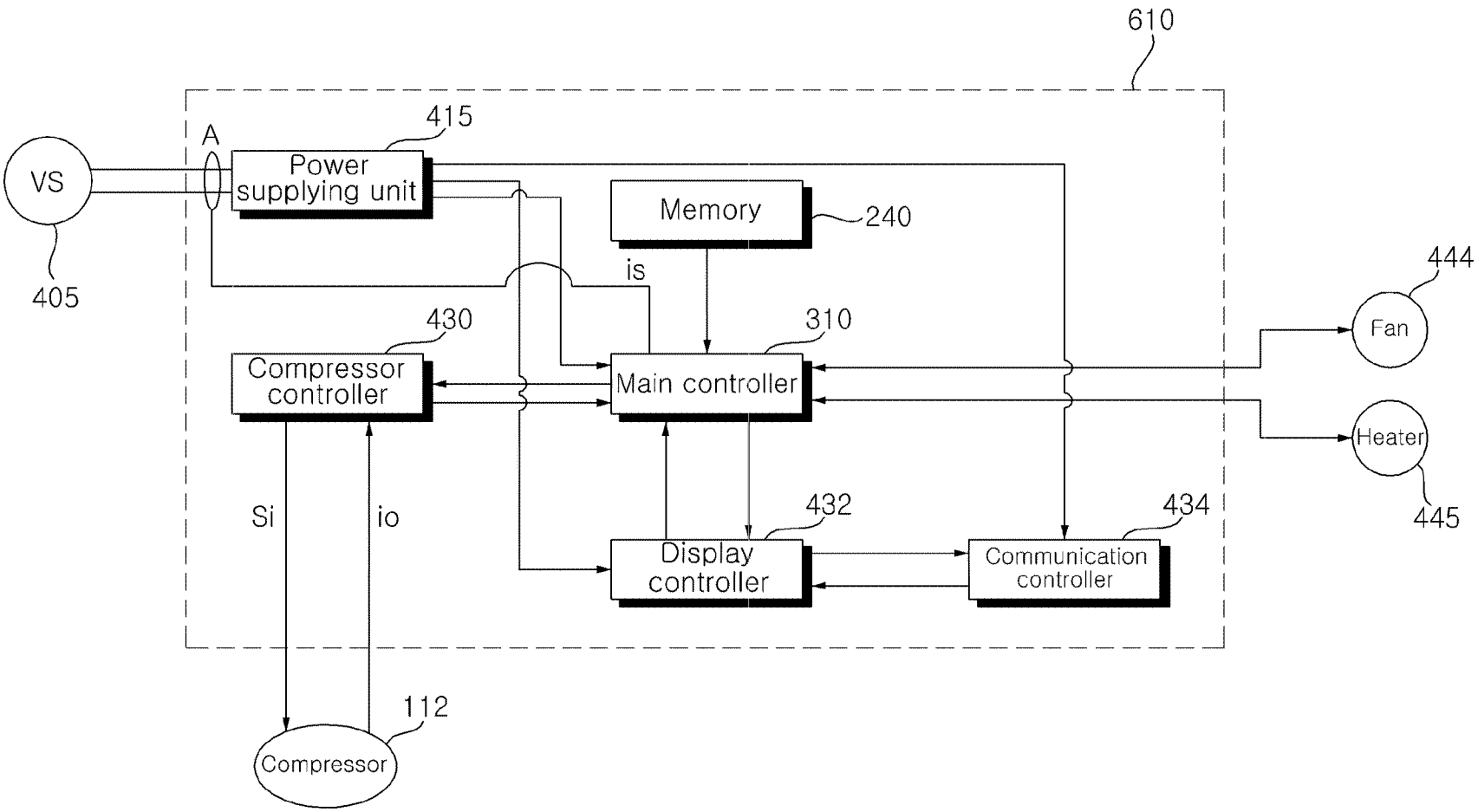
FIG. 14 is a view illustrating another example of a circuit unit in a refrigerator as shown in FIG. 1.

Meanwhile, according to an embodiment of the present invention, the main controller 310 may receive a detected current value for input power supplied to the refrigerator 1 from a current detector (A in FIG. 14). Meanwhile, the main controller 310 may grasp the overall operation state of the refrigerator.

Accordingly, according to an embodiment of the present invention, the main controller 310 estimates a power factor based on the detected current and the operation states of the freezing compartment defrosting heater (first heater) 330 and the refrigerating compartment defrosting heater (second heater) 331 and calculates power that is consumed in the refrigerator 1 based on the estimated power factor.

For example, the main controller 310, in case the freezing compartment defrosting heater 330 and the refrigerating compartment defrosting heater 331 operate but the compressor 112 does not, may estimate the power factor as a first power factor value and may calculate the power consumption as a first power value.

As another example, the main controller 310, in case the freezing compartment defrosting heater 330 operates but the refrigerating compartment defrosting heater 331 and the compressor 112 do not, may estimate the power factor as a second power factor value while calculating the power consumption as a second power value.

As still another example, the main controller 310, in case the freezing compartment defrosting heater 330 and the compressor 112 operate but the refrigerating compartment defrosting heater 331 does not, may estimate that the power factor decreases as the current detected increases, and using an estimated power factor, may calculate the power that is consumed in the refrigerator.

Meanwhile, the main controller 310, in case the compressor 112 operates but the freezing compartment defrosting heater 330 and the refrigerating compartment defrosting heater 331 do not, may estimate that the power factor increases as the current detected increases, and using an estimated power factor, may calculate the power that is consumed in the refrigerator.

Meanwhile, the main controller 310 may estimate a power factor using a power factor value and a computation equation stored in the memory 240 and may calculate power that is consumed in the refrigerator using the estimated power factor.

The main controller 310, in case the freezing compartment defrosting heater 330 and the compressor 112 operate, may conduct computation so that a variation in power factor or a variation in power consumption relative to the detected current is larger than when only the freezing compartment defrosting heater 330 operates while the compressor 112 does not.

The main controller 310, in case the compressor 112 operates, may perform computation so that a variation in power factor or a variation in power consumption relative to the detected current is larger than when the compressor 112 does not operate.

Figure 5:
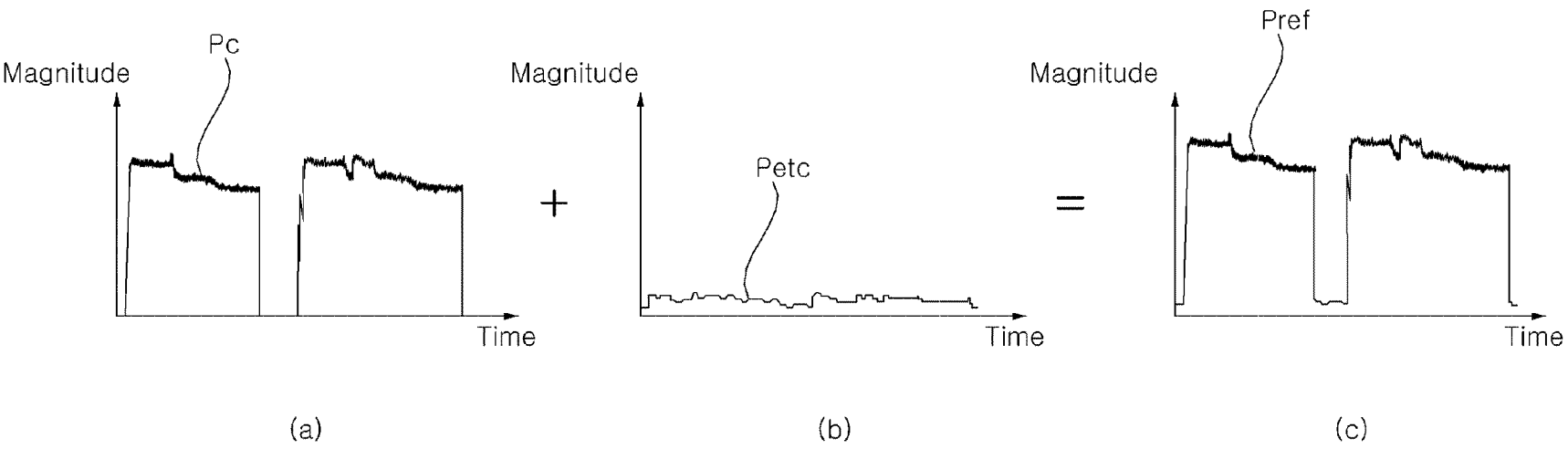
FIGS. 5(*a*) to 5(*c*) are timing diagrams illustrating a method of calculating a power consumption of a refrigerator according to an embodiment of the present invention.

As such, the power factor estimation and power consumption computation by the main controller 310 will be described below in further detail with reference to FIG. 14 and subsequent drawings. FIG. 4 is a view illustrating an example circuit unit in a refrigerator as shown in FIG. 1, and FIG. 5 is a view illustrating a method of calculating a power consumption of a refrigerator according to an embodiment of the present invention.

First, referring to FIG. 4, the circuit unit 610 of FIG. 4 may include at least one circuit board as provided in the refrigerator.

Specifically, the circuit unit 610 may include an input current detecting unit A (see FIG. 6), a power supplying unit 415, a main controller 310, a memory 240, a compressor controller 430, a display controller 432, and a communication controller 434.

First, the input current detecting unit A may detect an input current is that is inputted from a commercial AC power source 405. For this purpose, as the input current detecting unit A, a CT (current transformer) or a shunt resistor may be used. The detected input current is a discrete signal having a pulse form and may be inputted to the main controller 310 for estimating a power factor.

The power supplying unit 415 may power-transform input AC power and may generate operating power so that each unit in the circuit unit 610 can be operated. Here, the operating power may be DC power. For such purpose, the power supplying unit 415 may have a converter with a switching element or a rectifying unit without any switching element.

The compressor controller 430 outputs a signal for driving the compressor 112. Although not shown in the drawings, in order to operate a compressor motor provided in the compressor 112, an inverter (not shown) may be used, and the compressor controller 430 may control the inverter by outputting a switching control signal (Si) to the inverter (not shown). The compressor controller 430 may receive a current (io) flowing through the compressor motor to generate the switching control signal (Si) by feedback control.

The display controller 432 may control the display 231. The display controller 432 may generate data to be displayed on the display 231 and transfer the generated data to the display 231 or may deliver data input from the input unit 220 to the main controller 310.

The communication controller 434 may control a communication unit (not shown) provided in the refrigerator 1. Here, the communication unit (not shown) may include at least one of a radio communication unit, such as WiFi or Zigbee, a near field communication unit such as NFC, and a wired communication unit such as UART.

Although in the drawings the communication controller 434 and the display controller 432 exchange data, the present invention is not limited thereto. For example, the communication controller 434 may directly exchange data with the main controller 310.

Meanwhile, the main controller 310 may control the overall controlling operation in the refrigerator.

The main controller 310 may exchange data with the memory 240, the compressor controller 430, the display controller 432, and the communication controller 434. Further, the main controller 310 may exchange data with a fan 444 and a heater 445.

The fan 444 in FIG. 4 may collectively denote the above-described mechanical chamber fan (not shown) and freezing compartment fan 144, and the heater 445 in FIG. 4 may collectively denote the freezing compartment defrosting heater 330, a home bar heater (not shown), and a pillar heater (not shown).

The main controller 310 may grasp an operating state of a plurality of power consuming units in the refrigerator. For example, the main controller 310 may grasp an operating state of the compressor 112 via the compressor controller 430 and may directly grasp an operating state of, e.g., the freezing compartment defrosting heater 330 and the freezing compartment fan 144.

The main controller 310 may receive compressor power consumption information (Pc) that is calculated in the compressor controller 430, and based on whether a plurality of power consuming units operate, may obtain a final power consumption using pre-stored power consumption information for each unit and the calculated compressor power consumption information (Pc).

FIG. 5(*a*) is a timing diagram illustrating compressor power consumption information (Pc), and FIG. 5(*b*) is a timing diagram illustrating information on power (Petc) that is consumed in a power consuming unit in the refrigerator except for the compressor. The main controller 310 may receive compressor power consumption information (Pc) from the compressor controller 430, and according to the compressor power consumption information (Pc) and whether a plurality of power consuming units operate, may obtain a final power consumption information (Pref) by summing power consumption information for each unit, as shown in FIG. 5(*c*). Accordingly, the whole power consumption in the refrigerator can be simply obtained.

Meanwhile, the compressor controller 430 may calculate a compressor power consumption based on an output current flowing through the compressor motor. Accordingly, without installing a separate power consumption measuring unit, a compressor power consumption can be calculated, and a final power consumption can be obtained using power consumption of each unit, which has been previously measured and stored in the memory 240. Thus, manufacturing costs for calculating power consumption can be reduced.

Meanwhile, the main controller 310 may deliver the calculated final power consumption information (Pref) to the display controller 432. The display controller 432 may control the display 231 to display the final power consumption information (Pref) or consumption information accumulated based on the final power consumption information alongside predetermined period information.

Meanwhile, the display controller 432 may control not only the display 231 disposed on a freezing compartment door as described above, but also a dispenser motor 612 provided in the ice bank vibrator 175 for pulling out ice made in the ice maker 190. The display controller 432 may grasp whether-to-operate information (idm) of the dispenser motor 612 and may transfer the whether-to-operate information (idm) to the main controller 310.

Figure 6:
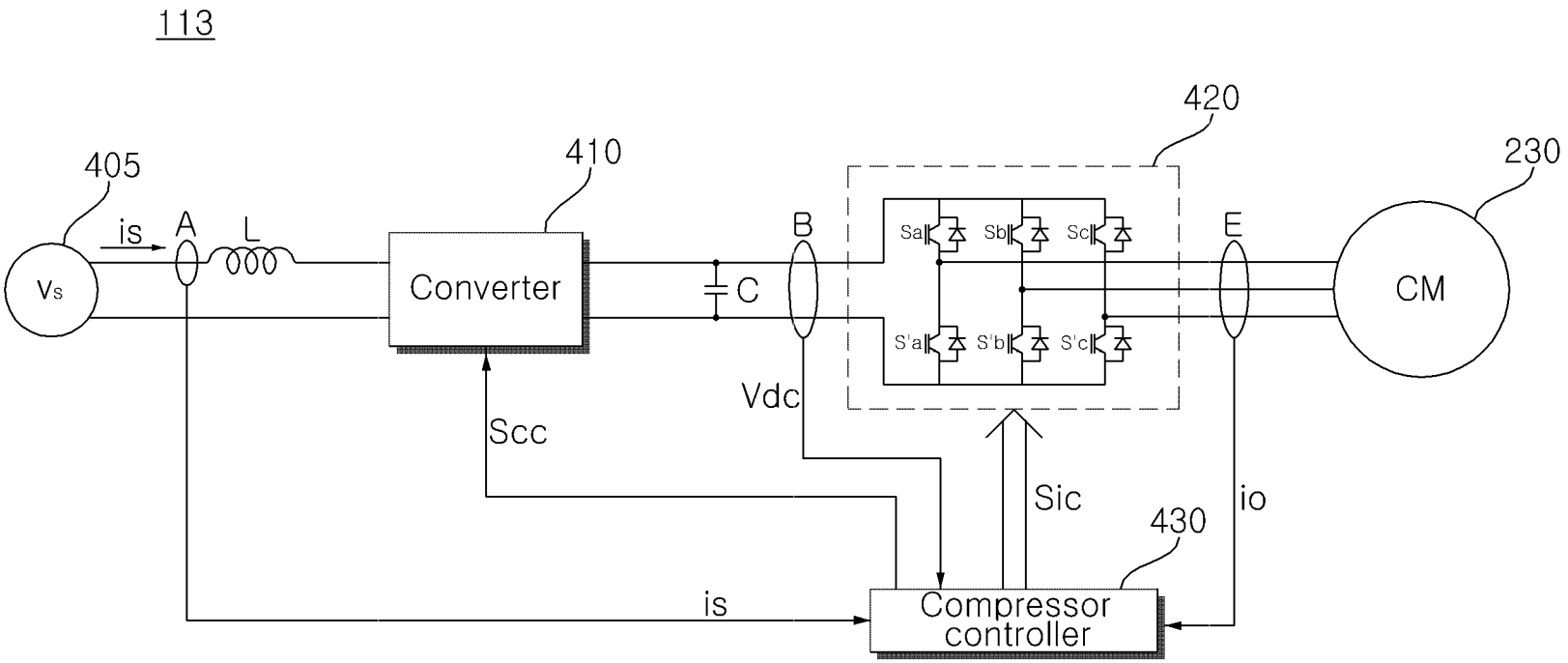
FIG. 6 is a circuit diagram illustrating a compressor driver as shown in FIG. 4.

FIG. 6 is a circuit diagram illustrating a compressor driver as shown in FIG. 4.

Referring to the drawings, the compressor driver 113 according to an embodiment of the present invention may include a converter 410, an inverter 420, a compressor controller 430, a dc-terminal detecting unit B, a capacitor C, and an output current detecting unit E. Further, the compressor driver 113 may include an input current detecting unit A and a reactor L.

The reactor L is disposed between the commercial AC power source 405 ($v_s$) and the converter 410 to perform operations such as power factor correction or voltage boosting. Further, the reactor L may function to limit a resonant current that is created by quick switching.

The input current detecting unit A may detect an input current (is) inputted from the commercial AC power source 405. For this, as the input current detecting unit A, a CT (current transformer) or a shunt resistor may be used. The detected input current (is) may be a discrete signal having a pulse form and may be inputted to the compressor controller 430.

The converter 410 converts commercial AC power 405 that has passed through the reactor L into DC power and outputs the DC power. Although in the drawings the commercial AC power 405 is single-phase AC power, it may also be three-phase AC power. Depending on the type of the commercial AC power source 405, the internal structure of the converter 410 may be varied.

Meanwhile, the converter 410 may consist of, e.g., diode(s) without any switching element and may perform a rectifying operation without a separate switching operation.

For example, in the case of a single-phase AC power source, four diodes may be bridged. In the case of a three-phase AC power source, six diodes may be bridged.

Meanwhile, the converter 410 may be a half-bridge converter that includes two switching elements and four diodes connected to each other. In the case of a three-phase AC power source, six switching elements and six diodes may be used.

In case the converter 410 includes a switching element, the converter 410 may perform operations such as voltage boosting, power factor enhancement, and DC conversion by the switching operation of the switching element.

The capacitor C smoothes power entered to the capacitor C and stores it. Although in the drawings one element is used as the capacitor C, a plurality of elements may also be used to secure element stability.

Meanwhile, although in the drawings the capacitor C is connected to an output terminal of the converter 410, the present invention is not limited thereto. For example, DC power may be directly inputted to the inverter 420. For example, DC power may be directly inputted from a solar cell to the capacitor C or may be DC/DC converted and then input. Hereinafter, the description will focus mainly on the portions illustrated in FIG. 6.

Meanwhile, DC power is stored through both terminals of the capacitor C, and thus, the terminals of the capacitor C may be denoted "DC terminals" or "DC link terminals."

The dc-terminal detecting unit B may detect a DC terminal voltage (Vdc) at both terminals of the capacitor C. For this, the dc-terminal detecting unit B may include a resistor or an amplifier. The detected DC terminal voltage (Vdc) may be a discrete signal having a pulse form and may be inputted to the compressor controller 430.

The inverter 420 includes a plurality of inverter switching elements. The inverter 420 may convert smoothed DC power (Vdc) into three-phase AC power (va, vb, vc) of a predetermined frequency and may output the three-phase AC power to a three-phase sync motor 230.

The inverter 420 includes a total of three pairs of upper arm and lower arm switching elements connected in parallel with each other, each pair consisting of upper arm switching elements Sa, Sb, Sc connected in series with each other and lower arm switching elements S'a, S'b, S'c connected in series with each other. A diode is connected in reverse direction in parallel with each switching element Sa, S'a, Sb, S'b, Sc, S'c.

The switching elements in the inverter 420 turn on/off based on an inverter switching control signal Sic from the compressor controller 430. Accordingly, three-phase AC power of a predetermined frequency is outputted to the three-phrase sync motor 230.

The compressor controller 430 may control a switching operation of the inverter 420. For this, the compressor controller 430 may receive an output current $i_o$ detected by the output current detecting unit E.

The compressor controller 430 outputs the inverter switching control signal Sic to the inverter 420 for controlling an switching operation of the inverter 420. The inverter switching control signal Sic is a pulse-width modulation (PWM) switching control signal and is generated and outputted based on an output current value (io) detected from the output current detecting unit E. The detailed operation of outputting the inverter switching control signal Sic in the compressor controller 430 will be described below in greater detail with reference to FIG. 11.

The output current detecting unit E detects an output current io flowing between the inverter 420 and the three-phase motor 230. That is, the output current detecting unit E detects a current flowing through the motor 230. The output current detecting unit E may detect all of the output currents ia, ib, ic at respective phases or may detect output currents from two phases using a three-phase equilibrium.

The output current detecting unit E may be positioned between the inverter 420 and the motor 230 and may use a CT (current transformer) or a shunt resistor for detecting current.

Three shunt resistors may be positioned between the inverter 420 and the sync motor 230 or their respective terminals may be connected to the three lower arm switching elements S'a, S'b, S'c, respectively, of the inverter 420. Meanwhile, two shunt resistors may be used using a three-phase equilibrium. Meanwhile, in case one shunt resistor is used, the shunt resistor may be disposed between the above-described capacitor C and the inverter 420.

The detected output current (io), as a discrete signal having a pulse form, may be applied to the compressor controller 430, and based on the detected output current (io), an inverter switching control signal Sic is generated. Hereinafter, the detected output current (io) is described as three-phase output currents ia, ib, ic.

Meanwhile, the compressor motor 230 may be a three-phase motor. The compressor motor 230 includes a stator and a rotator. Phase AC power of a predetermined frequency is applied to each phase stator coil so that the rotator rotates.

The motor 230 may include, e.g., a surface-mounted permanent-magnet synchronous motor (SMPMSM), an interior permanent magnet synchronous motor (IPMSM), and a synchronous reluctance motor (Synrm). Among them, the SMPMSM and the IPMSM are permanent magnet synchronous motors (PMSMs) while the Synrm does not include a permanent magnet.

Meanwhile, the compressor controller 430, in case the converter 410 includes a switching element, may control a switching operation of the switching element in the converter 410. For this, the compressor controller 430 may receive an input current (is) detected in the input current detecting unit A. The compressor controller 430 may output a converter switching control signal Scc to the converter 410 in order to control switching operation. Such converter switching control signal Scc is a pulse-width modulation (PWM)-based switching control signal and may be generated and outputted based on the input current (is) detected from the input current detecting unit A.

Meanwhile, the compressor controller 430 may calculate a compressor power consumption based on the output current (io) detected in the output current detecting unit E. For example, the compressor controller 430 may estimate an output voltage supplied to the compressor motor 230 using the detected output current (io) and may obtain a compressor power consumption using the estimated output voltage and output current (io).

Meanwhile, the compressor driver 113 may further include an output voltage detector (not shown) that is positioned between the inverter 420 and the compressor motor 230 to detect an output voltage supplied to the compressor motor 230.

In such case, the compressor controller 430 may immediately calculate a compressor power consumption using the output current (io) detected in the output current detecting unit E and the output voltage detected in an output voltage detector (not shown).

The compressor controller 430 transmits the calculated compressor power consumption (Pc) to the main controller 310 as described earlier.

Figure 7A:
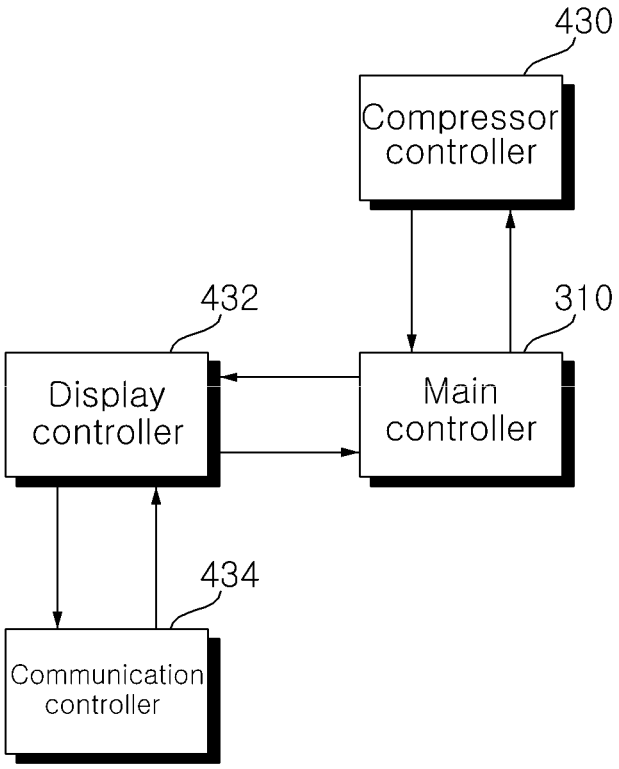
FIGS. 7(*a*) to 7(*c*) are block diagrams illustrating a method of performing data communication between controllers in a refrigerator according to an embodiment of the present invention.
Figure 7B:
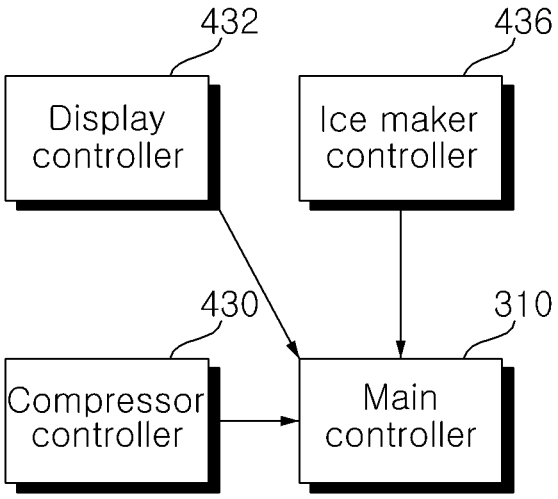
Figure 7C:
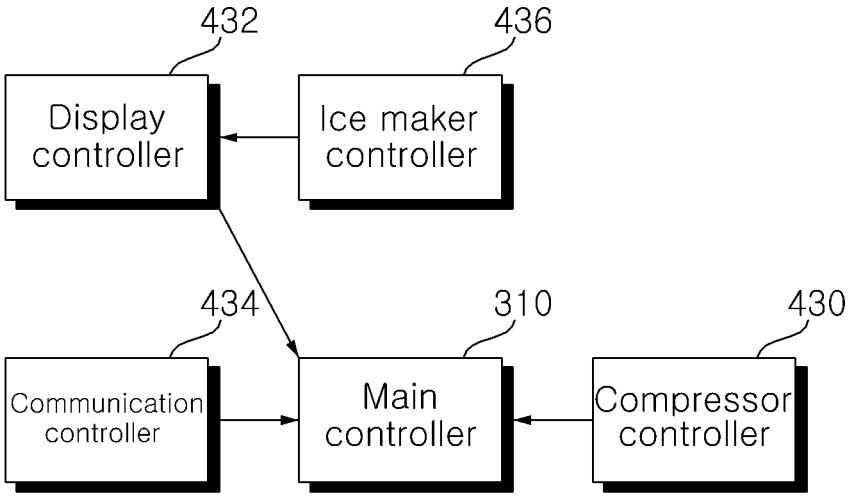

FIGS. 7*a* to 7*c* are block diagrams illustrating a data communication method by controllers in a refrigerator.

The main controller 310 according to an embodiment of the present invention may receive information on whether each power consuming unit operates from other controllers, such as the display controller, by various methods. Meanwhile, compressor power consumption is received from the compressor controller 430.

First, referring to FIG. 7*a*, the circuit unit 610 in the refrigerator may include a plurality of controllers, and as shown in the drawings, may include a main controller 310, a compressor controller 430, a display controller 432, and a communication controller 434.

The main controller 310 may directly exchange data with the compressor controller 430 and the display controller 432. The main controller 310 may exchange data with the communication controller 434 via the display controller 432.

In such case, the main controller 310 may receive compressor power consumption from the compressor controller 430 and may receive information on whether the display 231 operates, information (idm) on whether a dispenser motor associated with the ice bank vibrator 175 operates, information on whether the ice maker operates, and information on whether a communication unit (not shown) operates from the display controller 432. Here, the information on whether the communication unit operates is transmitted from the communication controller 434 to the display controller 432 and then to the main controller 310.

Next, referring to FIG. 7*b*, the circuit unit 610 in the refrigerator may include a main controller 310, a compressor controller 430, a display controller 432, and an ice maker controller 436. In the example illustrated in FIG. 7*b*, it may be assumed that neither a communication unit nor a communication controller is provided in the refrigerator.

The main controller 310 may directly exchange data with the compressor controller 430, the display controller 432, and the ice maker controller 436.

In such case, the main controller 310 may receive compressor power consumption from the compressor controller 430 and may receive information on whether the display 231 operates from the display controller 432, and the main controller 310 may receive information (idm) on whether a dispenser motor associated with the ice bank vibrator 175 operates and information on whether the ice maker operates from the ice maker controller 436.

Referring to FIG. 7*c*, the circuit unit 610 in the refrigerator may include a main controller 310, a compressor controller 430, a display controller 432, a communication controller 434, and an ice maker controller 436.

The main controller 310 may directly exchange data with the compressor controller 430, the display controller 432, and the communication controller 434 except for the ice maker controller 436. The main controller 310 may exchange data with the ice maker controller 436 via the display controller 432.

In such case, the main controller 310 may receive compressor power consumption from the compressor controller 430 and may receive information on whether the display 231 operates, information (idm) on whether a dispenser motor associated with the ice bank vibrator 175 operates, information on whether the ice maker operates from the display controller 432 and information on whether a communication unit (not shown) operates from the communication controller 434. Meanwhile, the information (idm) on whether the dispenser motor associated with the ice bank vibrator 175 operates and information on whether the ice maker operates are transmitted from the ice maker controller 436 to the display controller 432 and then to the main controller 310.

Meanwhile, information on whether, e.g., a defrosting heater 330, a home bar heater, a mechanical chamber fan motor, a freezing compartment fan motor, an illuminating unit for outputting light to the inside of the refrigerator, a blast chiller, or a filter heater as not described in connection with FIGS. 7*a* to 7*c* operate may be received by the main controller 310 via at least one of the controllers. Or, the corresponding information may be directly inputted to the main controller 310.

FIG. 8 is a view illustrating an example of power consumption for each unit stored in a memory.

Referring to FIG. 8, the power consumption for each unit may be stored in the memory 240 as a lookup table as shown. Referring to the table 1010, the power consumption of a defrosting heater is A1, the power consumption of a home bar heater is A2, and the power consumption of a circuit unit is A3. Among them, A1 which is the power consumption of the defrosting heater may be highest, and A3 which is the power consumption of the circuit unit may be lowest.

For example, the main controller 310, when the defrosting heater and circuit unit operate, may receive the power consumption (A1) of the defrosting heater and the power consumption (A3) of the circuit unit from the memory 240 and may sum them with a compressor power consumption (Pc), thereby obtaining a final power consumption.

Meanwhile, the table 1010 may store power consumption separately for each period for a mechanical fan motor and a freezing compartment fan motor. Referring to FIG. 8, when the mechanical fan motor operates, as its rotation speed reduces, the corresponding power consumption may vary in the sequence of A4-A5-A6. Similarly, when the freezing compartment fan motor operates, as its rotation speed slows down, the corresponding power consumption may vary in the sequence of A7-A8-A9.

For example, when the defrosting heater, the circuit unit, and the mechanical fan motor operate in a High speed, and the freezing compartment fan motor operates in a High speed, the main controller 310 may receive the power consumption A1 of the defrosting heater, the power consumption A3 of the circuit unit, the power consumption A5 of the mechanical fan motor, and the power consumption A7 of the freezing compartment fan motor from the memory 240 and may sum them with the compressor power consumption Pc to thereby obtain a final power consumption.

Meanwhile, also for the illuminating unit, blast chiller, ice bank, and pillar heater, which have not been illustrated in the table 1010 of FIG. 8, corresponding power consumption values may be stored in the memory 240.

Meanwhile, the table 1010 of FIG. 8 may be power consumptions that a manufacturer has previously obtained in experiment, and the items in the table or magnitude of the power consumption may vary depending on the refrigerator's model. Further, the items in the table or magnitude of the power consumption for each corresponding item may be updated through a communication unit (not shown).

Figure 9:
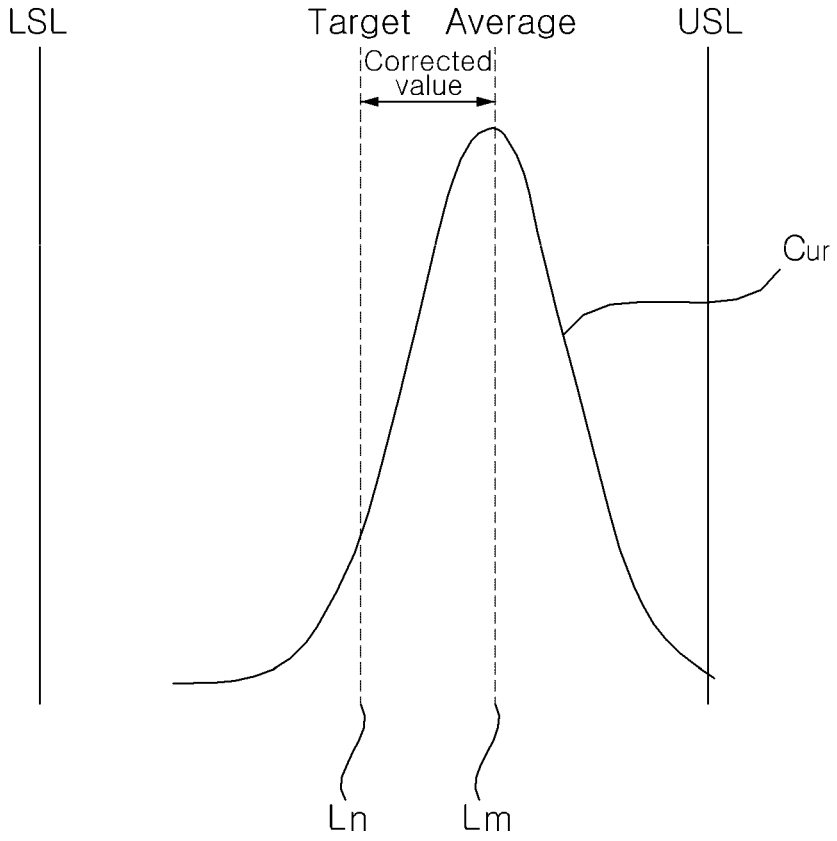
FIG. 9 is a view illustrating power consumption compensation according to an embodiment of the present invention.

FIG. 9 is a view illustrating compensating for power consumption.

Each power consumption unit in the refrigerator 10 has a part variation when manufactured. In consideration of this, the memory 240 may store information on the variation of each part.

In an embodiment of the present invention, in order to raise accuracy of the final power consumed in the refrigerator, as calculated in the main controller 310, each unit's power consumption is compensated considering the part variation.

Referring to FIG. 9, the degree of part variation may have a value between an LSL and a USL. In order to calculate a power consumption compensation value, an example is illustrated in the drawing, where a Gaussian pulse according to the part variation is shifted to the USL thereby producing a corrected value.

For example, an Ln value is stored in the memory as a power consumption of a unilateral defrosting heater. However, in case the variation of the freezing heater 330 is close to the USL, the main controller 310 may produce an Lm value as a compensated power consumption considering the power consumption compensation value. Accordingly, exact power consumption computation considering the part variation can be possible.

Meanwhile, the part variation occurs in each power consuming unit. However, in particular, the heaters in the refrigerator would have a higher chance to have a part variation.

Accordingly, in an embodiment of the present invention, the part variation-considered power consumption compensation, as described above in connection with FIG. 9, may be applied only to the heaters, such as the defrosting heater, home bar heater, and pillar heater, among the power consuming units in the refrigerator.

Meanwhile, various power consumption compensation schemes may apply other than the part variation-considered power consumption compensation described in connection with FIG. 9.

As another example of power consumption compensation, among the power consuming units in the refrigerator, units receiving AC power for their operation may be power-consumption compensated considering a high variation in the AC power.

As described above in connection with FIG. 6, in case the input AC power 405 is transformed into DC power through the converter 410, the DC power Vdc is smoothed and stored in the capacitor C. Thus, the dc-terminal voltage Vdc, which is a voltage between both terminals of the capacitor C is generally smoothed.

In contrast, the units operating with input AC power receive the input AC power, as is, without a separate smoothing means, so that this needs to be compensated considering an instantaneous value of the input AC power.

A compensating approach may use the dc-terminal voltage Vdc in the compressor driver 113 of FIG. 6. For example, the power consumption can be compensated as much as a gap between an instantaneous value of the dc-terminal voltage and a reference value (average) of the dc-terminal voltage.

For example, in case the defrosting heater 330 operates, and the reference value (average) of the dc-terminal voltage is 300 V while the instantaneous value of the dc-terminal voltage as detected in the dc-terminal voltage detector is 270V, the gap is 30V, which corresponds to 10% in ratio. Accordingly, the main controller 310, in case the power consumption stored in the memory with respect to the defrosting heater 330 is 30 W (A1 in FIG. 8), may compensate for it and may obtain 27 W as compensated power consumption. Then, the main controller 310 may sum the compensated power consumption (27 W) with the compressor power consumption (100 W), thereby obtaining a final power consumption of 127 W.

Meanwhile, as still another example of power consumption compensation, a peak power consumption that occurs due to a drastic load may be compensated.

For example, in case the defrosting heater 330 operates, and the reference value (average) of the dc-terminal voltage is 300 V while the instantaneous value of the dc-terminal voltage as detected in the dc-terminal voltage detector is 270V, the gap is 30V, which corresponds to 10% in ratio. Accordingly, the main controller 310, in case the power consumption stored in the memory with respect to the defrosting heater 330 is 30 W (A1 in FIG. 8), may compensate for it and may obtain 27 W as compensated power consumption.

Then, the main controller 310 may sum the compensated power consumption (27 W) with the compressor power consumption (100 W), thereby obtaining a final power consumption of 127 W.

Meanwhile, as still another example of power consumption compensation, a peak power consumption that occurs due to a drastic load may be compensated.

For this, the dc-terminal voltage Vdc in the compressor driver 113 of FIG. 6 may be used. That is, in case the instantaneous value of the dc-terminal voltage exceeds an allowable value for a predetermined time, a transient variation in load occurs, and the power consumption compensation can be performed using the load variation.

For example, in case the defrosting heater 330 operates, and the reference value (average) of the dc-terminal voltage is 300V, the allowable value is 400V, and the instantaneous value of the dc-terminal voltage detected in the dc-terminal voltage detector is 450V for six minutes, the gap from the reference value is 150V which corresponds to 50% in ratio. Accordingly, in case the power consumption stored in the memory with respect to the defrosting heater 330 is 30 W/h per hour (A1 in FIG. 8), the main controller 310 may perform compensation thereby to produce 33 W as compensated power consumption for the defrosting heater 330 considering a ratio (50%) that comes from a gap between a time factor (6/60) and reference value. The main controller 310 may then produce 133 W as final power consumption by summing the compensated power consumption 33 W with the compressor power consumption 100 W.

Meanwhile, as still another example of power consumption compensation, when a fan does not work due to a line disconnection, such failure can be compensated. For example, in case the main controller 310 issues a command so that the freezing compartment fan 144 operates but the circuit of the fan motor for the freezing compartment fan 144 is disconnected, the freezing compartment fan 144 does not actually operate, so that power consumption does not take place.

In such circumstance, the main controller 310, in case no output current is detected flowing through the fan motor or an output current is lower than a reference value, determines that the freezing compartment fan 144 is disconnected and may exclude the power consumption coming from the operation of the freezing compartment fan 144 from computation of a final power consumption.

By such various compensation schemes, the main controller 310 may exactly obtain a final power consumption.

Figure 10:
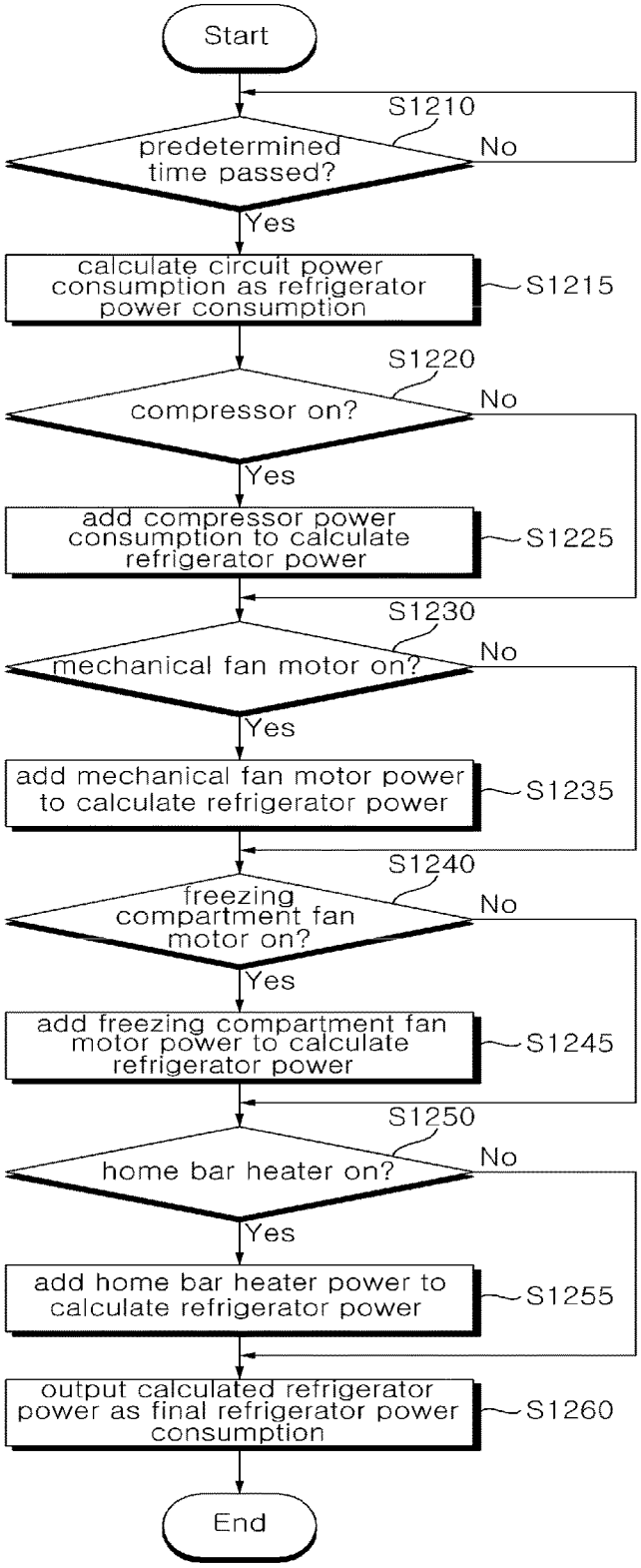
FIG. 10 is a flowchart illustrating a method of operating a refrigerator according to an embodiment of the present invention.

FIG. 10 is a flowchart illustrating a method of operating a refrigerator according to an embodiment of the present invention.

Referring to FIG. 10 which illustrates a method of calculating a final power consumption by a main controller 310, the main controller 310 first determines whether a predetermined time has elapsed since the previous computation of a final power consumption (S1210). If so, the main controller 310 first produces a circuit power consumption as the refrigerator's power consumption (S1215).

The main controller 310 may periodically calculate a final power consumption. For example, since the main controller 310 and the compressor controller 430 conduct communication every two seconds, a final power consumption can be calculated every other second.

Meanwhile, since the refrigerator's circuit unit always operates, the main controller 310 reads a power consumption A3 of the circuit unit, illustrated in FIG. 8, out of the memory 240 and determines it as power consumption.

Next, the main controller 310 determines based on information from the compressor controller 430 whether the compressor is on (S1220), and if so, calculates the refrigerator's power consumption by summing the circuit unit power consumption A3 and the compressor power consumption Pc, received from the compressor controller 430 (S1225).

Then, the main controller 310 determines whether the mechanical fan motor operates (S1230), and if so, reads out any one (A4) of the power consumptions (A4-A6) of the mechanical fan motor from the memory 240 and further sums the power consumption A4 of the mechanical fan motor (S1235).

Meanwhile, the main controller 310, unless the mechanical fan motor operates, does not sum the power consumption of the mechanical fan motor.

Thereafter, the main controller 310 determines whether the mechanical fan motor operates (S1240), and if so, reads out any one (A7) of the power consumptions (A7-A9) of the mechanical fan motor from the memory 240 and further sums the power consumption A7 of the mechanical fan motor (S1245).

Meanwhile, the main controller 310, unless the mechanical fan motor operates, does not sum the power consumption of the mechanical fan motor.

Next, the main controller 310 determines whether the home bar heater operates (S1250), and if so, reads out the power consumption A2 of the home bar heater from the memory 240 and further sums the power consumption A2 of the home bar heater (S1255).

Meanwhile, the main controller 310, in case the home bar heater does not operate, does not sum the power consumption of the home bar heater.

Next, the main controller 310 calculates and outputs the power consumption summed in steps S1215 to S1255 as a final power consumption (S1260). Accordingly, the display 231 may display the final power consumption.

At this time, the display 231 may display the refrigerator's power consumption for a first period (e.g., one day) or for a second period (e.g., one month).

Or, the display 231 may display whether the refrigerator power consumption has increased or decreased through a period-to-period comparison. Or, the display 231 may also display whether the expense for the refrigerator power consumption has increased or decreased through a comparison between one period and another.

Meanwhile, the display 231 may display the information on the refrigerator power consumption at every predetermined period or for a predetermined time (e.g., 15 minutes).

Accordingly, a user may intuitively recognize the refrigerator compressor.

Figure 11:
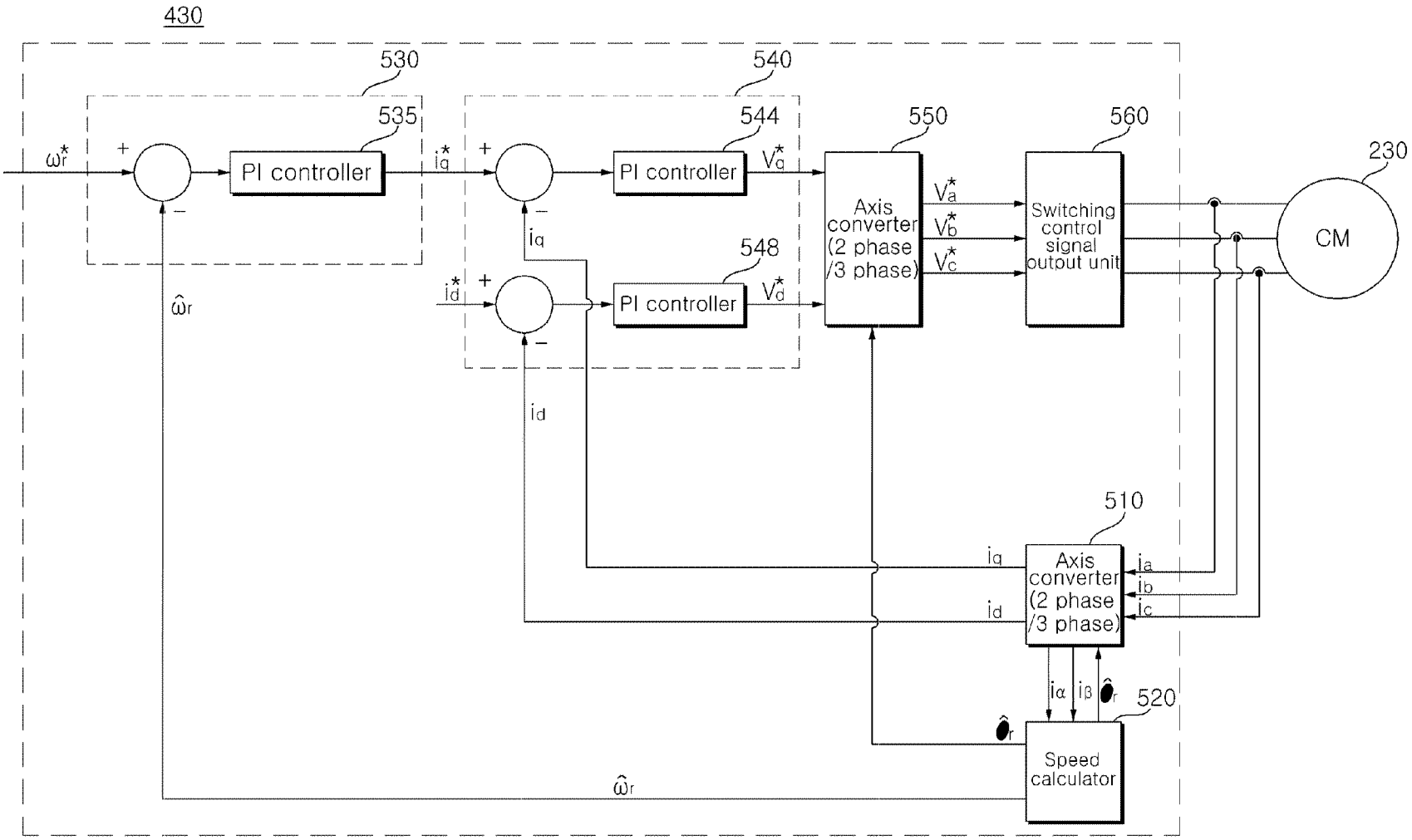
FIG. 11 is a circuit diagram illustrating an example of a compressor controller as shown in FIG. 6.

Referring to FIG. 11, the compressor controller 430 may include an axis converter 510, a speed calculator 520, a current command generating unit 530, a voltage command generating unit 540, an axis converter 550, and a switching control signal output unit 560.

The axis converter 510 receives three-phase output currents ia, ib, is detected in the output current detecting unit E and converts them into two-phase currents iα and iβ in the absolute coordinate system.

Meanwhile, the axis converter 510 may convert the two-phase currents iα and iβ in the absolute coordinate system into two-phase currents id and iq in the rotating coordinate system.

The speed calculator 520 may output a position $\hat{\theta}_r$ of computation and a speed $\hat{\theta}_r$ of computation based on the two-phase currents iα and iβ axis-converted in the axis converter 510.

Meanwhile, the current command generating unit 530 generates a current command value $i^*_q$ based on a computation speed $\hat{\omega}_r$ and a speed command value $\omega^*_r$. For example, the current command generating unit 530 performs PI control in a PI controller 535 based on the computation speed $\hat{\omega}_r$ and speed command value $\omega^*_r$ and may generate the current command value $i^*_q$. In FIG. 11, a q-axis current command value $i^*_q$ is illustrated as an example of the current command value. However, unlike that shown in FIG. 11, a d-axis current command value $i^*_d$ may be generated together. Meanwhile, the d-axis current command value $i^*_d$ may be set as 0.

Meanwhile, the current command generating unit 530 may further include a limiter (not shown) to restrict the level of the current command value $*_q$ so as to prevent the current command value $*_q$ from exceeding an allowable range.

Next, the voltage command generating unit 540 generates d-axis and q-axis voltage command values $v^*_d, v^*_q$ based on the current command values $i^*_d, i^*_q$ in, e.g., the current command generating unit 530 and the d-axis and q-axis currents $i_d, i_q$ axis-converted into the two-phase rotating coordinate system in the axis converter. For example, the voltage command generating unit 540 performs PI control in the PI controller 544 based on a difference between the q-axis current $i_q$ and the q-axis current command value $i^*_q$ and may generate a q-axis voltage command value $v^*_q$. Further, the voltage command generating unit 540 performs PI control in the PI controller 548 based on a difference between the d-axis current $i_d$ and the d-axis current command value $i^*_d$ and may generate a d-axis voltage command value $v^*_d$. Meanwhile, the voltage command generating unit 540 may further include a limiter (not shown) to restrict the levels of the d-axis and q-axis voltage command values $v^*_d, v^*_q$ so that the d-axis and q-axis voltage command values $v^*_d, v^*_q$ do not exceed an allowable range.

Meanwhile, the generated d-axis and q-axis voltage command values $v^*_d, v^*_q$ are input to the axis converter 550.

The axis converter 550 receives the d-axis and q-axis voltage command values $v^*_d, v^*_c$, and the position $\hat{\omega}_r$ calculated in the speed calculator 520 and performs an axis conversion.

First, the axis converter 550 performs conversion from the two-phase rotating coordinate system into the two-phase absolute coordinate system. At this time, the position $\hat{\theta}_r$ calculated in the speed calculator 520 may be used.

The axis converter 550 performs conversion from the two-phase absolute coordinate system into the three-phase absolute coordinate system. By such conversion, the axis converter 550 outputs three-phase output voltage command values v*a,v*b,v*c.

The switching control signal output unit 560 generates an inverter switching control signal Sic according to a pulse-width modulation (PWM) scheme based on the three-phase voltage command values v*a,v*b,v*c.

The output inverter switching control signal Sic is converted into a gate driving signal in a gate driver (not shown) and may be inputted to the gate of each switching element in the inverter 420. Accordingly, the switching elements Sa,S'a,Sb,S'b,Sc,S'c in the inverter 420 perform switching operations.

Figure 12:
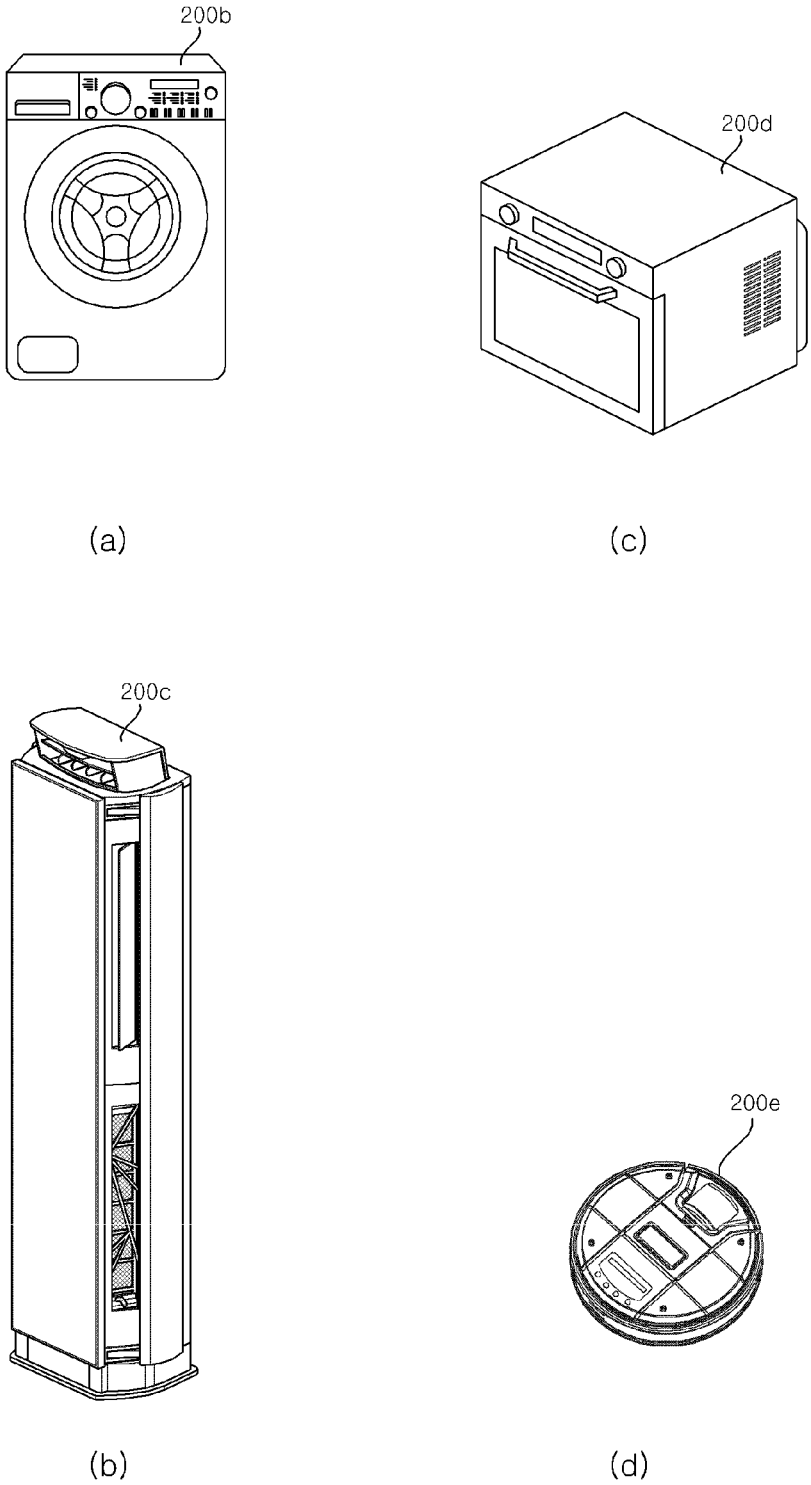
FIGS. 12(*a*) to 12(*d*) illustrate various home appliance examples according to another embodiment of the present invention.
Figure 13:
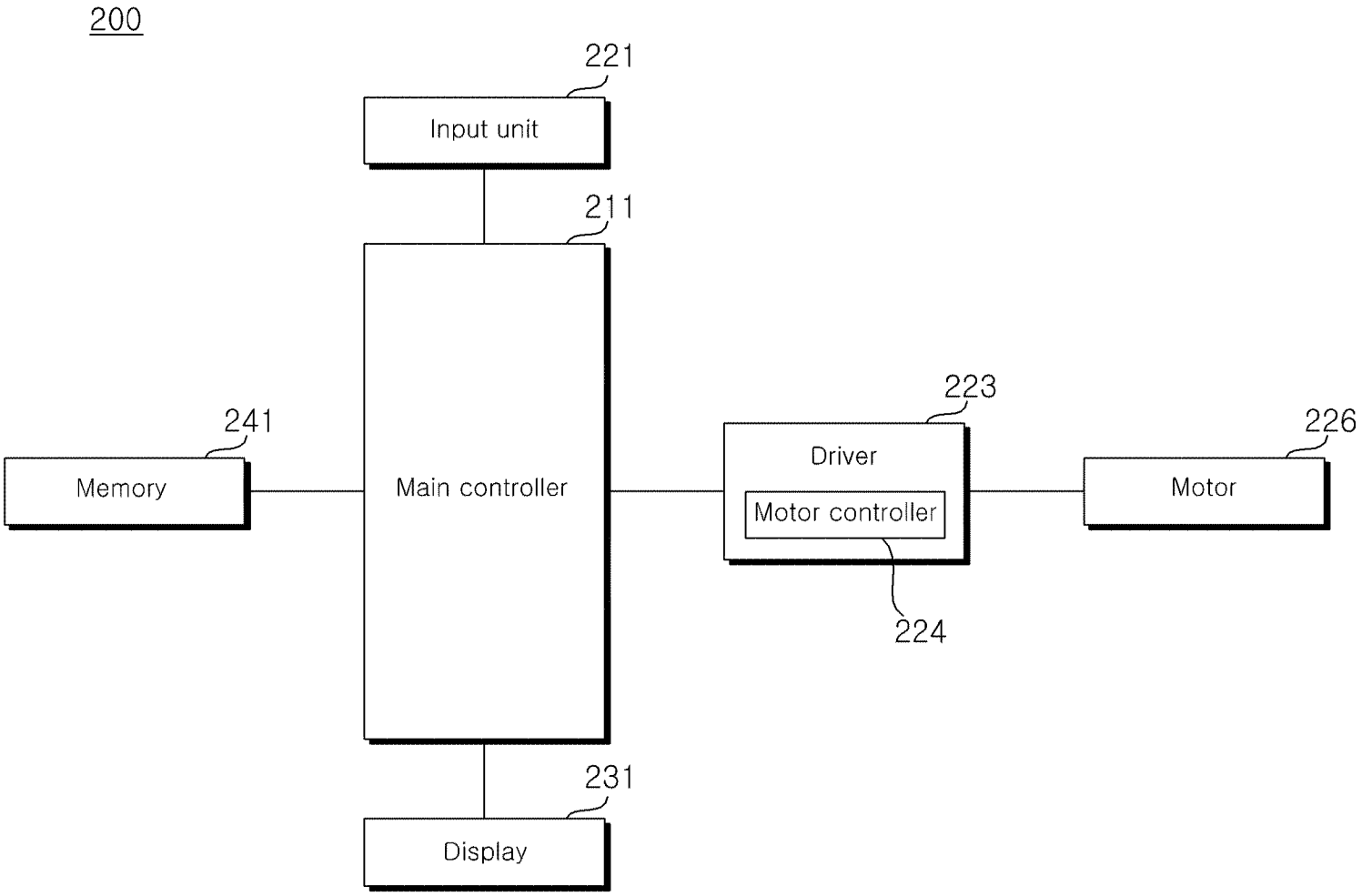
FIG. 13 is a block diagram schematically illustrating an example of a circuit unit in a home appliance as shown in FIG. 12.

FIG. 12 shows various examples of a home appliance according to another embodiment of the present invention, and FIG. 13 is a block diagram illustrating an example of a circuit unit in a home appliance as shown in FIG. 12.

The home appliance according to an embodiment of the present invention may include a first power consuming unit, a first controller that calculates a first power consumed in the first power consuming unit, a plurality of power consuming units, and a main controller that receives the calculated first power information and calculates a final power consumption using the calculated power consumption information and pre-stored power consumption information for each unit, when plurality of power consuming units operate.

The home appliance may include a refrigerator 1 as shown in FIG. 1, a washing machine 200*b* as shown in FIG. 4(*a*), an air conditioner 200*c* as shown in FIG. 4(*b*), a cooker 200*d* as shown in FIG. 4(*c*), and a robot cleaner 200*e* as shown in FIG. 4(*d*). Hereinafter, the description will focus on the washing machine 200*b* shown in FIG. 4(*a*), the air conditioner 200*c* shown in FIG. 4(*b*), the cooker 200*d* shown in FIG. 4(*c*), and the robot cleaner 200*e* shown in FIG. 4(*d*), except for the refrigerator 1 described above.

The home appliance 200 shown in FIG. 13 may include an input unit 221 for a user's entry, a display 231 for displaying, e.g., an operating state of the home appliance, a driver 223 for driving the home appliance, a memory 241 for storing the product information and operating information of the home appliance, and a main controller 211 for performing the overall control of the home appliance.

For example, in case the home appliance is a washing machine 200*b*, the driver 223 may include a motor controller 224 for driving a motor 226 that supplies a rotational force to a drum or tub.

As another example, in case the home appliance is an air conditioner 200*c*, the driver 223 may include a motor controller 224 for driving a compressor motor in the outdoor unit.

As still another example, in case the home appliance is a cooker 200*d*, the driver 223 may include a microwave controller (not shown) for outputting a microwave into a cavity.

As yet still another example, in case the home appliance is a cleaner 200*e*, the driver 223 may include a motor controller 224 for driving a fan motor for sucking air or a motor operated for moving.

The home appliance 200 may obtain a final power consumption by calculating a power consumption for a maximum power consuming unit that consumes the most power while calculating power consumptions for the other power consuming units using the power consumption information pre-stored in the memory 241.

For example, in case the home appliance is an air conditioner 200*c*, the motor controller 224 for driving a compressor motor may calculate the compressor's power consumption. The computation of the compressor power consumption may be performed based on an output current flowing through the compressor motor similar to the refrigerator. The computation of power consumptions of the other power consuming units may be performed using the values stored in the memory 241. Finally, the main controller 211 may calculate a final power consumption using the calculated compressor power consumption and the power consumption of each unit as stored in the memory 241. Accordingly, a final power consumption can be simply acquired.

Meanwhile, in case the home appliance is a washing machine 200*b*, the motor controller 224 may calculate a power consumption of a motor for rotating a drum or tub. The motor's power consumption may be calculated based on an output current flowing through the motor. The power consumption of the other power consuming units may be obtained using the values stored in the memory 241. At last, the main controller 211 may obtain a final power consumption using the calculated motor power consumption and the power consumption of each unit as stored in the memory 241. Therefore, a final power consumption can be simply obtained.

Meanwhile, in case the home appliance is a cooker 200*d*, the controller (not shown) in the driver may calculate a power consumption in the microwave generator that operates to generate a microwave. The power consumption of the microwave generator, in case the microwave generator (not shown) operates based on an inverter (not shown), may be calculated by the controller in the driver based on an output current from the inverter (not shown). The power consumption of the other power consuming units may be calculated using the values stored in the memory 241. Finally, the main controller 211 may calculate a final power consumption using the calculated power consumption of the microwave generator and the power consumption of each unit as stored in the memory 241. Thus, a final power consumption can be simply obtained.

Meanwhile, in case the home appliance is a cleaner 200*e*, the motor controller 224 may calculate a power consumption of the motor. The motor power consumption may be calculated based on an output current flowing through the motor. The power consumption for the other power consuming units may be calculated using the values stored in the memory 241. Finally, the main controller 211 may calculate a final power consumption using the calculated motor power consumption and the power consumption of each unit as stored in the memory 241. Accordingly, a final power consumption can be simply obtained.

Meanwhile, the home appliance 200, as described above in connection with the refrigerator, may perform various power consumption compensation schemes. In particular, the home appliance 200 may compensate for the power consumption stored in the memory 241.

For example, the main controller 211 may compensate for a power consumption for at least one of units operated by AC power among a plurality of power consuming units. Specifically, in case some units are operated by AC power, a power compensation can be conducted considering an instantaneous value of the AC power. Based on the compensated power consumption information and calculated power consumption information, a final power consumption can be calculated.

As another example, the main controller 211 may perform power consumption compensation on at least one of units whose power consumption is larger than a predetermined value among the plurality of power consuming units. Specifically, among a plurality of power consuming units, a defrosting heater can be subjected to power consumption compensation considering a part variation.

Meanwhile, in this connection, the main controller 211 might not perform power consumption compensation on units whose power consumption is less than a reference value among the plurality of power consuming units even when a compensation condition is met. That is, the power consumption is small, and thus, a predetermined level of error can be acceptable.

As another example, the main controller 211 may compensate for power consumption of each unit based on the part variation of a plurality of power consuming units as stored in the memory 240 and whether the plurality of power consuming unit operates and may calculate a final power consumption based on the compensated power consumption information and calculated power consumption.

As still another example, the main controller 211, in case DC power applied to the DC terminals for driving a motor is in excess of an allowable value for a predetermined time, may perform power compensation on the power consumption of some units that are in operation among the plurality of power consuming units and may calculate a final power consumption based on the compensated power consumption information and calculated power consumption information.

Meanwhile, the main controller 211 might not compensate for the power consumption of a circuit unit associated with a circuit board (PCB) among the plurality of power consuming units.

Meanwhile, the main controller 211, in case sudden peak power occurs in a period for power computation, may compensate for power considering the sudden peak power and might not separately compensate for power unless the time when the sudden peak power occurs departs from the power computation period.

FIG. 14 is a view illustrating another example of a circuit unit in a refrigerator as shown in FIG. 1.

Referring to FIG. 14, the circuit unit 610 of FIG. 14 may include at least one circuit board provided in the refrigerator.

Specifically, the circuit unit 610 may include an input current detecting unit A, a power supplying unit 415, a main controller 310, a memory 240, a compressor controller 430, a display controller 432, and a communication controller 434.

First, the input current detecting unit A may detect an input current that is inputted from a commercial AC power source 405. For this purpose, as the input current detecting unit A, a CT (current transformer) or shunt resistor may be used. The detected input current is a discrete signal having a pulse form and may be inputted to the main controller 310 for estimating a power factor.

The power supplying unit 415 may convert input AC power to generate operating power for operating each unit in the circuit unit 610. Here, the operating power may be DC power. For this, the power supplying unit 415 may have a converter with a switching element or a rectifier without any switching element.

The compressor controller 430 outputs a signal for driving the compressor 122. Although not shown in FIG. 14, an inverter (not shown) may be used for driving the compressor motor provided in the compressor 122. The compressor controller 430 may control the inverter by outputting a switching control signal Si in the inverter (not shown). The compressor controller 430 may receive a current flowing through the compressor motor and may generate a switching control signal Si by feedback control.

The display controller 432 may control the display 231. The display controller 432 may generate data to be displayed on the display 231 and transfer the generated data to the display 231 or may deliver data input from the input unit 220 to the main controller 310.

The communication controller 434 may control a communication unit (not shown) provided in the refrigerator 1. Here, the communication unit (not shown) may include at least one of a radio communication unit, such as WiFi or Zigbee, a near field communication unit such as NFC, and a wired communication unit such as UART.

Although in FIG. 14 the communication controller 434 and the display controller 432 exchange data, the present invention is not limited thereto. For example, the communication controller 434 may directly exchange data with the main controller 310.

Meanwhile, the main controller 310 may control the overall controlling operation in the refrigerator.

The main controller 310 may exchange data with the memory 240, the compressor controller 430, the display controller 432, and the communication controller 434. Further, the main controller 310 may exchange data with a fan 444 and a heater 445.

The fan 444 in FIG. 14 may collectively denote the above-described refrigerating compartment fan 142 and freezing compartment fan 144, and the heater 445 in FIG. 14 may collectively denote the freezing compartment defrosting heater 330 and refrigerating compartment defrosting heater 331.

The main controller 310 may grasp the operating state of the freezing compartment defrosting heater 330 and the refrigerating compartment defrosting heater 331 and the main controller 310 that consume high power among the plurality of power consuming units in the refrigerator. For example, the main controller 310 may grasp the operating state of the main controller 310 via the compressor controller 430 and may directly grasp the operating state of the freezing compartment defrosting heater 330 and the refrigerating compartment defrosting heater 331.

The main controller 310 may estimate a power factor based on an input current that is detected in the input current detecting unit A.

For example, in case the input current of the commercial AC power is 220V, the effective value $V_{RMS}$ of the input voltage has a fixed value, 220V. As another example, in case the input voltage of the commercial AC power is 110V, the effective value $V_{RMS}$ of the input voltage has a fixed value, 110V.

Since power factor is associated with the phase difference between the input voltage and input current, if an input current value is known, a power factor can be calculated or estimated. In case a power factor is known, power can be obtained from Equation 1:

$$P=V_{RMS}\times I_{RMS}\times PF \quad \text{[Equation 1]}$$

Here, P is input power, $V_{RMS}$ is an effective value of an input voltage, $I_{RMS}$ is an effective value of an input current, and PF is a power factor.

Resultantly, if the input power P is calculated, the power consumption in the refrigerator 1 can be obtained.

For this, in an embodiment of the present invention, as described above, an input current is detected, and based on the input current value, i.e., the effective value $I_{RMS}$ of the input current, a power factor is estimated.

Upon estimation of a power factor, the value can vary depending on the operating state of a power consuming unit in the refrigerator. FIG. 15 illustrates examples of the power factor and power consumption of the freezing compartment defrosting heater 330, the refrigerating compartment defrosting heater 331, and the compressor 112 among the power consuming units in the refrigerator, depending on operating states.

FIGS. 15 to 17*d* are views illustrating a method of calculating a power consumption in a refrigerator according to another embodiment of the present invention, based on FIG. 14.

First, referring to FIG. 15, the table 500 of FIG. 15 includes information on the power factor and power consumption according to the operating state of the freezing compartment defrosting heater 330, the refrigerating compartment defrosting heater 331, and the compressor 112, and this table 500 may be stored in the memory 240.

The table 500 of FIG. 15 includes the following separated operating states (1) to (4) for the freezing compartment defrosting heater 330, the refrigerating compartment defrosting heater 331, and the compressor 112.

(1) the freezing compartment defrosting heater 330 and the refrigerating compartment defrosting heater 331 are on while the compressor 112 is off;

(2) the freezing compartment defrosting heater 330 is on while the refrigerating compartment defrosting heater 331 and the compressor 112 are off;

(3) the freezing compartment defrosting heater 330 and the compressor 112 are on while the refrigerating compartment defrosting heater 331 is off; and (4) the freezing compartment defrosting heater 330 and the refrigerating compartment defrosting heater 331 are off while the compressor 112 is on.

FIGS. 16*a* to 17*d* show examples of power factor values relative to current values and power values relative to currents as actually detected in case the freezing compartment defrosting heater 330, the refrigerating compartment defrosting heater 331, and the compressor 112 have the above-described operating states (1) to (4).

The result of measurement shows that the power consumption is highest with operating state (1) and decreases in the order of (2), (3), and (4).

Figure 16A:
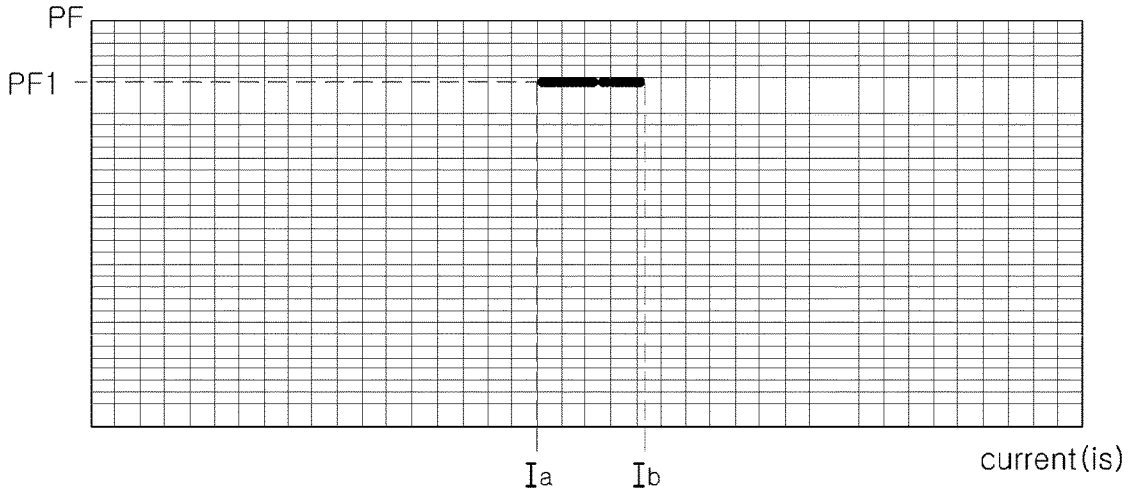
Figure 17A:
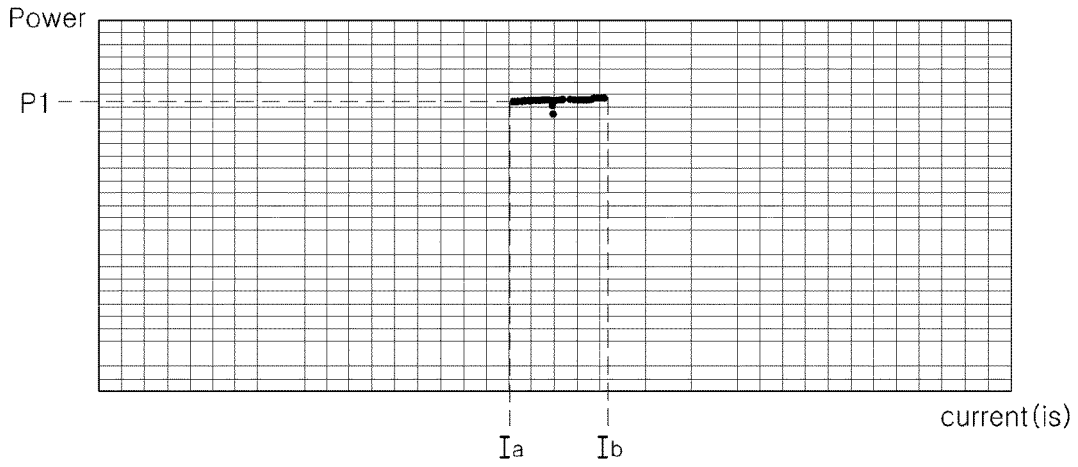

As in (1), in case the freezing compartment defrosting heater 330 and the refrigerating compartment defrosting heater 331 are on while the compressor 112 is off, the input current values are detected as Ia to Ib as shown in FIG. 16*a*, and at this time, the power factor has a constant value, PF1. The power consumption value is measured as about P1 in case the input current values are Ia to Ib as shown in FIG. 17*a*. Here, the PF1 value means the same value as K1 in FIG. 15.

Figure 16B:
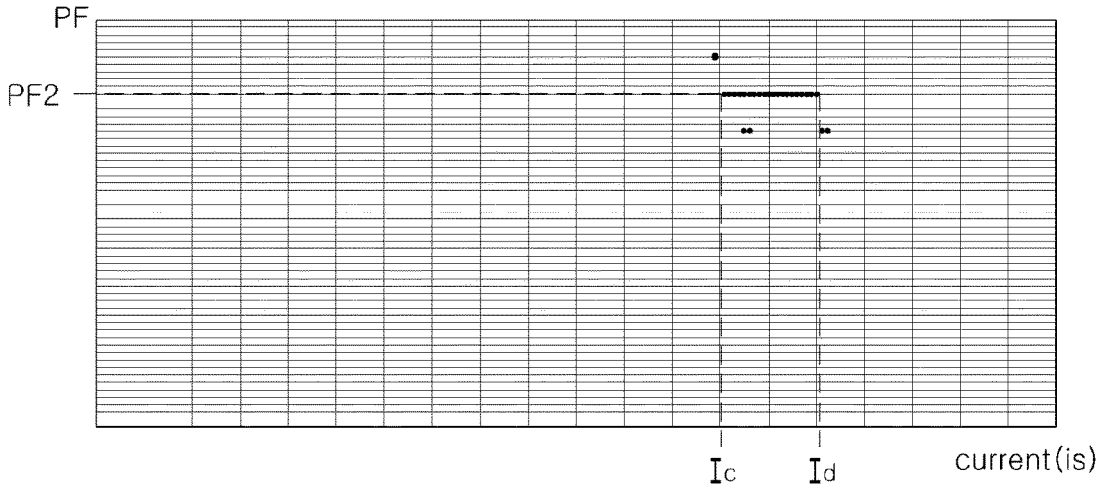
Figure 17B:
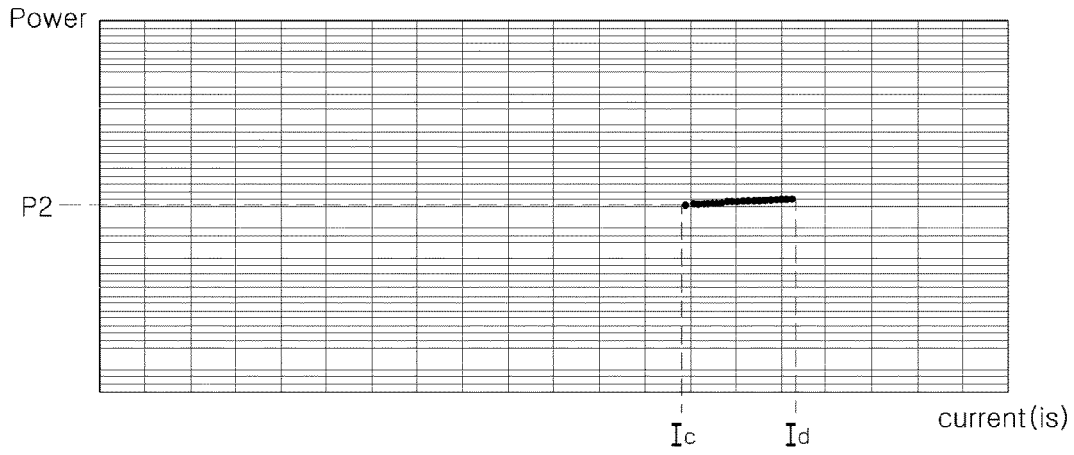

Next, as in (2), when the freezing compartment defrosting heater 330 is on while the refrigerating compartment defrosting heater 331 and the compressor 112 are off, the input current values, as shown in FIG. 16*b*, are detected as Ic to Id, and at this time, the power factor has a constant value, PF2. The power consumption value, in case the input current values are Ic to Id as shown in FIG. 17*b*, is measured as about P2. Here, PF2 means the same value as K2 in FIG. 15.

Meanwhile, Ic to Id are smaller than Ia to Ib, and PF2 is smaller than PF1, and P2 is smaller than P1. That is, in case (1), the magnitude, power factor, and power consumption of a detected current value is larger than in case (2).

Figure 16C:
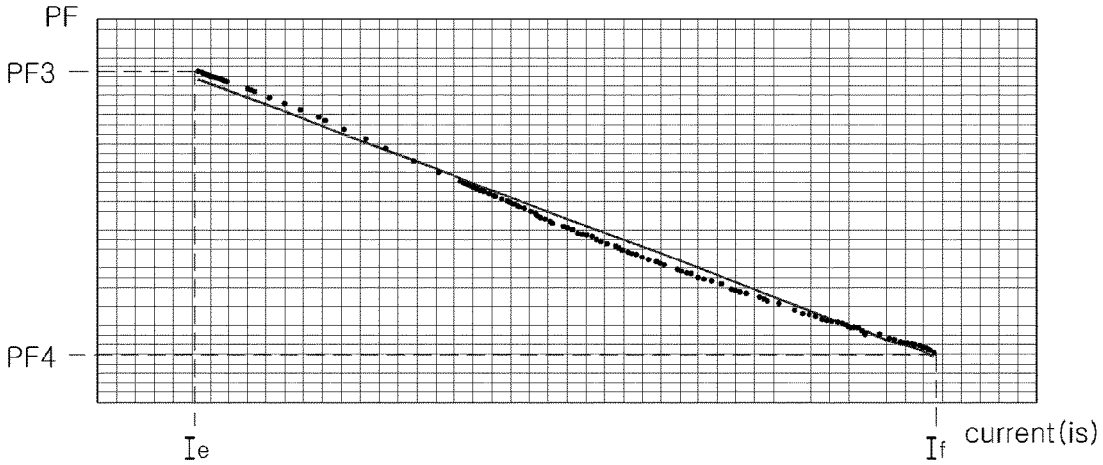
Figure 17C:
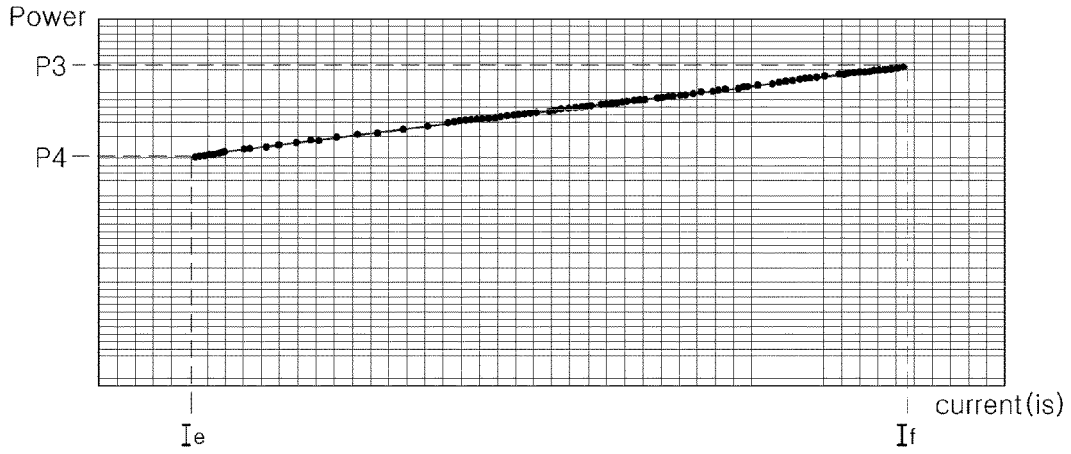

Next, as in (3), when the freezing compartment defrosting heater 330 and the compressor 112 are on while the refrigerating compartment defrosting heater 331 is off, the input current values are detected as Ie to If as shown in FIG. 16*c*, and at this time, the power factor has values (PF3 to PF4) decreasing with a constant slope respective of the input current values. The related equation may be f1(i) as shown in FIG. 15. The power consumption value, in case the input current values are Ie to If as shown in FIG. 17*c*, has values (P4 to P3) increasing a constant slope respective of the input current values. The related equation may be fa(i) as shown in FIG. 15. Here, f1(i) and fa(i) may be linear functions.

Figure 16D:
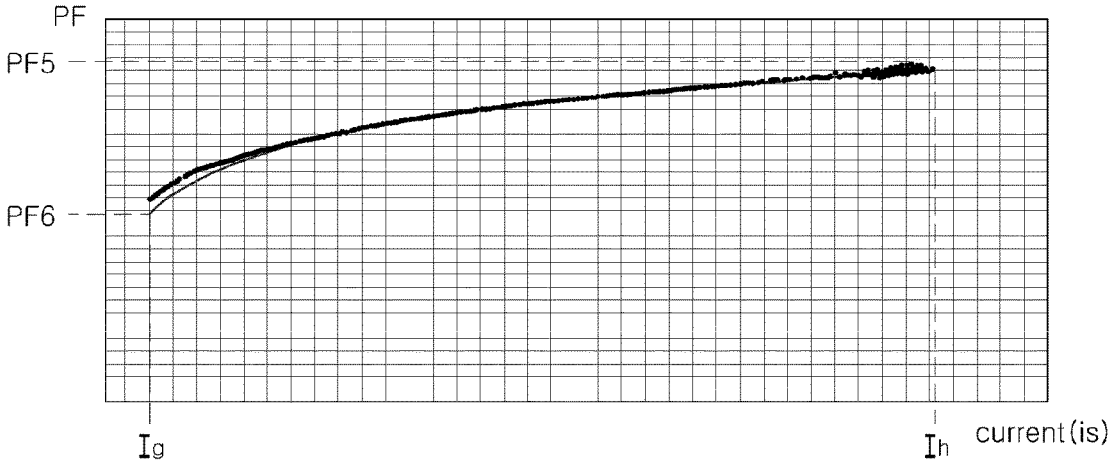
Figure 17D:
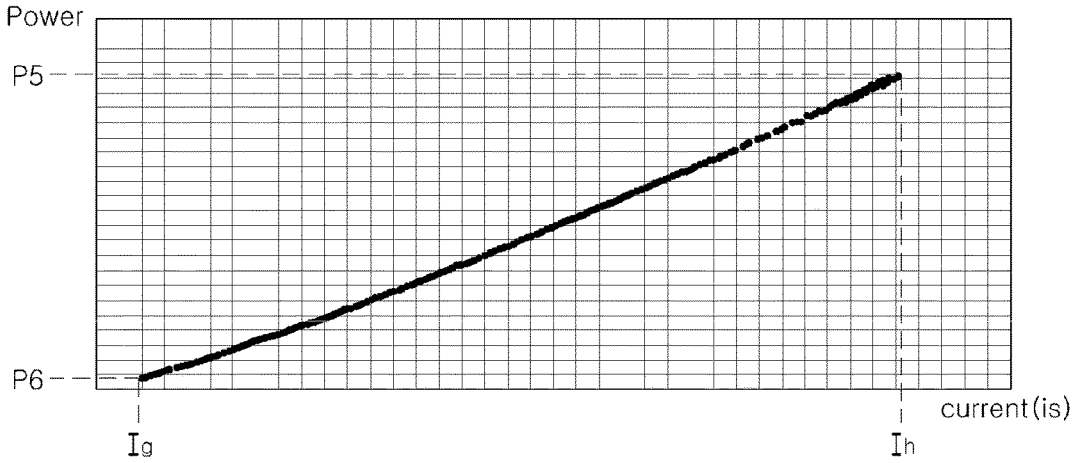

Next, as in (4), when the freezing compartment defrosting heater 330 and the refrigerating compartment defrosting heater 331 are off while the compressor 112 is on, the input current values are detected as Ig to Ih as shown in FIG. 16*d*, and at this time, the power factor has values (PF6 to PF5) sequentially increasing respective of the input current values. The related equation may be f2(i) as shown in FIG. 15. The power consumption value, in case the input current values are Ig to Ih as shown in FIG. 17*d*, has values (P6 to P5) sequentially increasing respective of the input current values. The related equation may be fb(i) as shown in FIG. 15. Here, f2(i) and fb(i) may be logarithmic functions.

Here, Ig to Ih are smaller than Ie to If, PF2 in FIG. 16(*d*) is smaller than PF1, and P2 is smaller than P1. That is, in case (3), the magnitude, power factor, and power consumption of a detected current value are larger than in case (4).

The main controller 310 may determine one of the above-described operating states (1) to (4) based on the input current value detected in the input current detecting unit A. The main controller 310 may estimate a power factor using one of the operating states (1) to (4) and the detected input current value, and based on the estimated power factor, may calculate a power consumption. That is, as illustrated in FIG. 15, the estimation of a power factor and computation of a power consumption can be performed by selecting any one of the operating states (1) to (4).

Accordingly, the power consumption of the overall refrigerator 1 can be simply calculated only with the input current value detected in the input current detecting unit A.

As another example, the main controller 310 may first determine which one of (1) to (4) the operating state is, estimate a power factor using any one of the operating states (1) to (4) and the input current value detected in the input current detecting unit A, and based on the estimated power factor, calculate a power consumption. That is, as illustrated in FIG. 15, the estimation of a power factor and computation of a power consumption can be conducted by selecting any one of (1) to (4).

That is, as in (1), when the freezing compartment defrosting heater 330 and the refrigerating compartment defrosting heater 331 operate while the compressor 112 does not, for example, the main controller 310 may estimate the power factor as a first power factor value PF1 and may calculate the power consumption as a first power value P1.

Further, as in (2), when the freezing compartment defrosting heater 330 operates while the refrigerating compartment defrosting heater 331 and the compressor 112 do not, the main controller 310 may estimate the power factor as a second power factor value PF2 and may calculate the power consumption as a second power value P2.

Further, as in (3), when the freezing compartment defrosting heater 330 and the compressor 112 operate while the refrigerating compartment defrosting heater 331 does not, the main controller 310 may estimate the power factor based on the equation f1(i) so that as the magnitude of current detected increases, the power factor decreases, and calculates power based on equation fa(i).

Further, as in (4), when the compressor 112 operates while the freezing compartment defrosting heater 330 and the refrigerating compartment defrosting heater 331 do not, the main controller 310 estimates the power factor based on the equation f2(i) so that as the magnitude of current detected increases, the power factor increases, and calculates the power based on the equation fb(i).

Accordingly, the overall power consumption of the refrigerator 1 can be simply obtained only with the operating states of the power consuming units and input current value detected in the input current detecting unit A.

Meanwhile, the display 231 may display the power consumption calculated by the main controller 310, as well as the operating state of the refrigerator.

In a refrigerator, home appliance, and method of operating the same according to the embodiments of the present invention, the present invention are not limited to what has been described above, and all or some of the embodiments set forth herein can be selectively combined in various ways.

A method of operating a refrigerator according to the embodiments of the present invention may be implemented as codes in a recording medium that may be read by a processor provided in the refrigerator. The recording medium that may be read by the processor includes all types of recording devices that store data readable by the processor. Examples of the recording medium readable by the process include a ROM, a RAM, a CD-ROM, a magnetic tape, a floppy disc, an optical data storage unit, and what is implemented in the form of a carrier wave such as transmission through the Internet. Further, the recording medium readable by the processor may be distributed in a calculator system connected via a network so that process-readable codes may be stored and executed in a distributive manner.

Although preferred embodiments of the present invention have been described thus far, the present invention is not limited thereto, and various modifications and changes can be made by those of ordinary skill in the art without departing from the scope of the following claims.

What is claimed is:

1. A refrigerator comprising:

a motor to drive a compressor;

a converter to convert an input AC power into a DC power;

a capacitor to store the DC power from the converter;

an inverter to convert the DC power into an output AC power and to output the AC power to the motor to drive the compressor;

a DC-terminal detecting unit to detect a DC terminal voltage at both terminals of the capacitor;

an output current detector to detect an output current flowing to the motor;

a compressor controller to output a switching control signal to the inverter for driving the compressor based on the detected output current, and to calculate compressor power information consumed in the compressor based on the detected output current;

a communication unit that performs a wired communication or a wireless communication;

a plurality of power consuming units including a defrosting heater and a freezing compartment fan motor;

a memory to store power consumption information for each of the plurality of power consuming units and to output corresponding power consumption information, when the plurality of power consuming units operate; and a main controller to receive the calculated compressor power consumption information, and when the plurality of power consuming units operate, to calculate a final refrigerator power consumption using power consumption information stored for each power consuming unit operated and the calculated compressor power consumption information, wherein at least one of items of power consuming units in the memory or at least one of magnitude of the power consumption information for each corresponding item is updated through the communication unit, wherein in case the defrosting heater operates, the main controller compensates power consumption stored in the memory with respect to the defrosting heater based on a gap between average value of the DC-terminal voltage and instantaneous value of the DC-terminal voltage from the DC-terminal detecting unit, wherein the main controller, in case no output current is detected flowing through the freezing compartment fan motor or an output current is lower than a reference value, determines that freezing compartment fan motor is disconnected and excludes the power consumption of the freezing compartment fan motor from the final refrigerator power consumption.

2. The refrigerator of claim 1, wherein the plurality of power consuming units include a circuit unit, a mechanical fan motor, and an illuminating unit and further includes at least one of a blast chiller, an ice bank vibrator, a home bar heater, or a pillar heater.

3. The refrigerator of claim 1, further comprising an output voltage detector to detect an output voltage supplied to the motor, wherein the compressor controller calculates the compressor power consumption based on the detected output current and the output voltage.

4. The refrigerator of claim 1, wherein the main controller compensates for power consumptions of at least some power consuming units that are in operation among the plurality of power consuming units and calculates the refrigerator power consumption based on the compensated power consumptions and the calculated compressor power consumption information.

5. The refrigerator of claim 4, wherein when the at least some power consuming units are operated by AC power, the main controller performs the power compensation based on an instantaneous value of the AC power.

6. The refrigerator of claim 4, wherein when the at least some power consuming units are operated by AC power, the main controller compensates for the power consumptions of the at least some power consuming units stored in the memory using a difference value between a value of the DC power and a DC reference value and calculates a refrigerator power consumption in the refrigerator based on the calculated compressor power consumption information and the compensated power consumption information.

7. The refrigerator of claim 1, further comprising a display to display the refrigerator power consumption information or accumulated refrigerator power consumption information based on the refrigerator power consumption.

8. The refrigerator of claim 7, further comprising at least any one of:

a display controller to control the display;

an ice maker controller to control an ice maker; and a communication controller to control the communication unit, wherein the main controller receives at least one of operating information of the display, operating information of the ice maker, operating information of the communication unit, and operating information of an ice bank for ejecting ice made in the ice maker from at least one of the display controller, the ice maker controller, and the communication controller.

9. The refrigerator of claim 1, wherein the main controller compensates for a power consumption in each power consuming unit based on the part variations of the plurality of power consuming units and whether the plurality of power consuming units operate and calculates the refrigerator power consumption using the compensated power consumption information and the calculated compressor power consumption.

10. The refrigerator of claim 1, wherein when the DC power exceeds an allowable value for a predetermined time, the main controller compensates for power consumptions of at least some power consuming units that are in operation among the plurality of power consuming units using a difference value between the allowable value of the DC power and an instantaneous value of the DC power and calculates the refrigerator power consumption based on the compensated power consumption information and the calculated compressor power consumption information.

* * * * *